US009518803B2

(12) United States Patent
Wassmer et al.

(10) Patent No.: US 9,518,803 B2
(45) Date of Patent: Dec. 13, 2016

(54) AUTOMATIC PIN ADJUSTMENT INDICATOR FOR ARCHERY SIGHTS

(71) Applicant: Bear Archery, Inc., Evansville, IN (US)

(72) Inventors: Jeffrey Alan Wassmer, Evansville, IN (US); David Eugene Hahn, Elberfeld, IN (US); Josh Sidebottom, Evansville, IN (US)

(73) Assignee: Bear Archery, Inc., Evansville, IN (US)

( * ) Notice: Subject to any disclaimer, the term of this patent is extended or adjusted under 35 U.S.C. 154(b) by 203 days.

(21) Appl. No.: 14/485,064

(22) Filed: Sep. 12, 2014

(65) Prior Publication Data

US 2015/0075016 A1 Mar. 19, 2015

Related U.S. Application Data

(60) Provisional application No. 61/878,822, filed on Sep. 17, 2013, provisional application No. 62/015,776, filed on Jun. 23, 2014.

(51) Int. Cl.
*F41G 1/467* (2006.01)
*F41G 1/033* (2006.01)

(52) U.S. Cl.
CPC ..... *F41G 1/467* (2013.01); *F41G 1/033* (2013.01)

(58) Field of Classification Search
CPC ..... F41G 1/467; F41G 1/033
USPC ..... 33/265; 124/87
See application file for complete search history.

(56) References Cited

U.S. PATENT DOCUMENTS

| | | | | |
|---|---|---|---|---|
| 3,320,670 | A * | 5/1967 | Ambraziatis | F41G 1/467 33/265 |
| 3,674,002 | A | 7/1972 | Diamond, Sr. | |
| 4,153,999 | A | 5/1979 | O'Steen | |
| 4,535,747 | A | 8/1985 | Kudlacek | |
| 4,689,887 | A | 9/1987 | Colvin | |
| 4,846,141 | A | 7/1989 | Johnson | |
| 4,910,874 | A * | 3/1990 | Busch | F41G 1/467 124/87 |
| 4,984,373 | A | 1/1991 | Forrest | |
| 5,072,716 | A | 12/1991 | Sappington | |
| 5,103,568 | A | 4/1992 | Canoy | |

(Continued)

OTHER PUBLICATIONS

International Search Report and Written Opinion issued in PCT/US2014/055590, dated Dec. 26, 2014, 10 pgs.

(Continued)

*Primary Examiner* — R. A. Smit
*Assistant Examiner* — Tania Courson
(74) *Attorney, Agent, or Firm* — Woodard, Emhardt, Moriarty, McNett & Henry LLP

(57) ABSTRACT

Certain embodiments include archery bow sights which incorporate pin adjustment mechanisms which can be set to automatically arrange sight pins in appropriate proportional spacing for various target ranges based on the spacing of two initial points. In certain embodiments, a first pin on an archery bow sight is calibrated at a first reference distance to define a first reference point on the sight. The bow and sight is then used at a second reference distance to determine and align a second reference point for a second sight pin. As aligned, the mechanism controls one or more additional sight pins to correspond with additional reference distances. In certain embodiments illustrated herein, the pin adjustment mechanism arranges pins within a vertically aligned orientation.

19 Claims, 24 Drawing Sheets

(56) References Cited

U.S. PATENT DOCUMENTS 5,228,204 A 7/1993 Khoshnood
5,239,760 A 8/1993 Dixon et al.
5,368,006 A * 11/1994 McPherson ..... F41B 5/10 124/25.6
5,384,966 A 1/1995 Gibbs
5,419,051 A * 5/1995 Barngrover ..... F41G 1/467 124/87
5,560,113 A * 10/1996 Simo ..... F41G 1/467 124/87
5,676,122 A 10/1997 Wiseby et al.
RE36,266 E 8/1999 Gibbs
5,946,812 A 9/1999 Slates
6,061,919 A * 5/2000 Reichert ..... F41G 1/467 124/87
6,418,633 B1 * 7/2002 Rager ..... F41G 1/467 124/87
6,564,462 B1 * 5/2003 Henry ..... F41G 1/467 124/87
6,618,949 B1 9/2003 Keener
6,651,350 B1 * 11/2003 Manns ..... F41G 1/467 124/87
6,796,039 B2 9/2004 Walbrink
6,823,597 B2 * 11/2004 Larson ..... F41G 1/467 33/265
6,938,349 B2 * 9/2005 Afshari ..... F41G 1/467 124/87
7,000,327 B2 * 2/2006 Rager ..... F41G 1/467 124/87
7,036,234 B2 * 5/2006 Rager ..... F41G 1/467 124/87
7,086,161 B2 8/2006 Ellig et al.
7,159,325 B2 * 1/2007 Rager ..... F41G 1/467 124/87
7,243,432 B1 * 7/2007 Rager ..... F41G 1/467 124/87
7,275,328 B1 * 10/2007 Rager ..... F41G 1/467 33/265
7,278,216 B2 10/2007 Grace
7,308,891 B2 12/2007 Graf
7,328,515 B2 * 2/2008 Helm ..... F41G 1/467 124/87
7,343,686 B2 * 3/2008 Rager ..... F41G 1/467 124/87
7,392,590 B2 7/2008 Gordon
7,578,067 B2 * 8/2009 Rager ..... F41G 1/467 124/87
7,721,453 B1 5/2010 Young
2003/0177651 A1 * 9/2003 Stone ..... F41G 1/467 33/265
2005/0183272 A1 * 8/2005 Meadows ..... F41G 1/467 33/265
2008/0010841 A1 1/2008 Gordon
2008/0168671 A1 7/2008 Rager
2009/0000134 A1 1/2009 Kurtzhals et al.
2009/0133272 A1 5/2009 Lewis
2009/0139100 A1 6/2009 Kingsbury
2009/0235540 A1 9/2009 Rager
2010/0107430 A1 5/2010 Deien
2011/0252654 A1 10/2011 Edmundson

OTHER PUBLICATIONS

International Application No. PCT/US2012/054812 International Search Report and Written Opinion, mailed Feb. 26, 2013.

* cited by examiner

AUTOMATIC PIN ADJUSTMENT INDICATOR FOR ARCHERY SIGHTS

CROSS-REFERENCE TO RELATED APPLICATIONS

This application claims the benefit of U.S. Provisional Patent Application Ser. No. 61/878,822 filed on Sep. 17, 2013 and U.S. Provisional Patent Application Ser. No. 62/015,776 filed on Jun. 23, 2014, which are incorporated herein by reference in their entirety.

FIELD OF THE INVENTION

Aspects of the present invention deal with archery bows, and in particular deal with accessories such as sights usable with archery bows.

BACKGROUND OF THE INVENTION

A bow sight can be used to assist an archer in aiming a bow. A typical bow sight includes a sight housing secured to the frame of a bow by one or more brackets. The sight housing often defines a viewing opening (i.e., a sight window) through which an archer can frame a target. The bow sight also typically includes at least one sighting member, such as a pin, that projects into the viewing opening. The sighting member defines and supports a sight point. The sight point is the point the archer aligns with the target during aiming. In use, the archer draws the drawstring of the bow and adjusts the position of the bow so that the intended target is visible through the viewing opening. While continuing to peer through the viewing opening with the bowstring drawn, the archer adjusts the position of the bow so that the sight point aligns with the intended target from the archer's eye. Once the sight point is aligned with the intended target, the archer releases the bowstring to shoot the arrow. "Target" herein can mean either a target being hunted or a fixed target. One example of a vertically adjustable sight is illustrated in U.S. Pat. No. 7,275,328.

The vertical position of one or more sight points is preferably set and calibrated to the user and bow so that each sight point position corresponds to a different target distance. Multiple sighting members are generally arranged in either a vertically aligned orientation, such as discussed in U.S. Pat. No. 6,418,633 or a horizontal orientation, such as discussed in U.S. Pat. No. 5,103,568. In certain embodiments, the sight points can be adjusted vertically to calibrate the sight points for differing target distances. Lower sight point positions typically correspond to longer target distances.

Adjustment of multiple sight pins for different distances often involves an archer, through trial and error, "sighting in" the bow at each distance so that each sight point position is accurately associated with a particular target distance. An alternate approach is to use computer software based on bow speed and other variables to prepare and print a sight tape which is then mounted on the bow sight and provides guidance for individually adjusting sight pins for various target distances. A still alternate approach, as discussed in U.S. Pat. No. 7,392,590, uses a multi-pitch lead screw to simultaneously adjust multiple sight pins.

SUMMARY OF THE INVENTION

In certain embodiments, an archery sight is mounted or mountable on an archery bow which includes a riser with a handle, upper and lower limb portions extending from the handle to limb tip sections and rotational members supported at the limb tip sections. A bowstring extends between the rotational members. The sight is typically secured to the riser. The sight incorporates an adjustment assembly to control the desired position of one or more additional sight pins based on sighted in positions of two base sight pins.

Certain embodiments include archery bow sights which incorporate pin adjustment mechanisms which can be set to automatically arrange sight pins in appropriate proportional spacing for various target ranges based on the spacing of two initial points. In certain embodiments, a first pin on an archery bow sight is calibrated at a first reference distance to define a first reference point on the sight. The bow and sight is then used at a second reference distance to determine and align a second reference point for a second sight pin. As aligned, the mechanism controls one or more additional sight pins to correspond with additional reference distances. In certain embodiments illustrated herein, the pin adjustment mechanism arranges pins within a vertically aligned orientation.

Additional objects and advantages of the described embodiments are apparent from the discussions and drawings herein.

DESCRIPTION OF PREFERRED EMBODIMENTS

Figure 1:
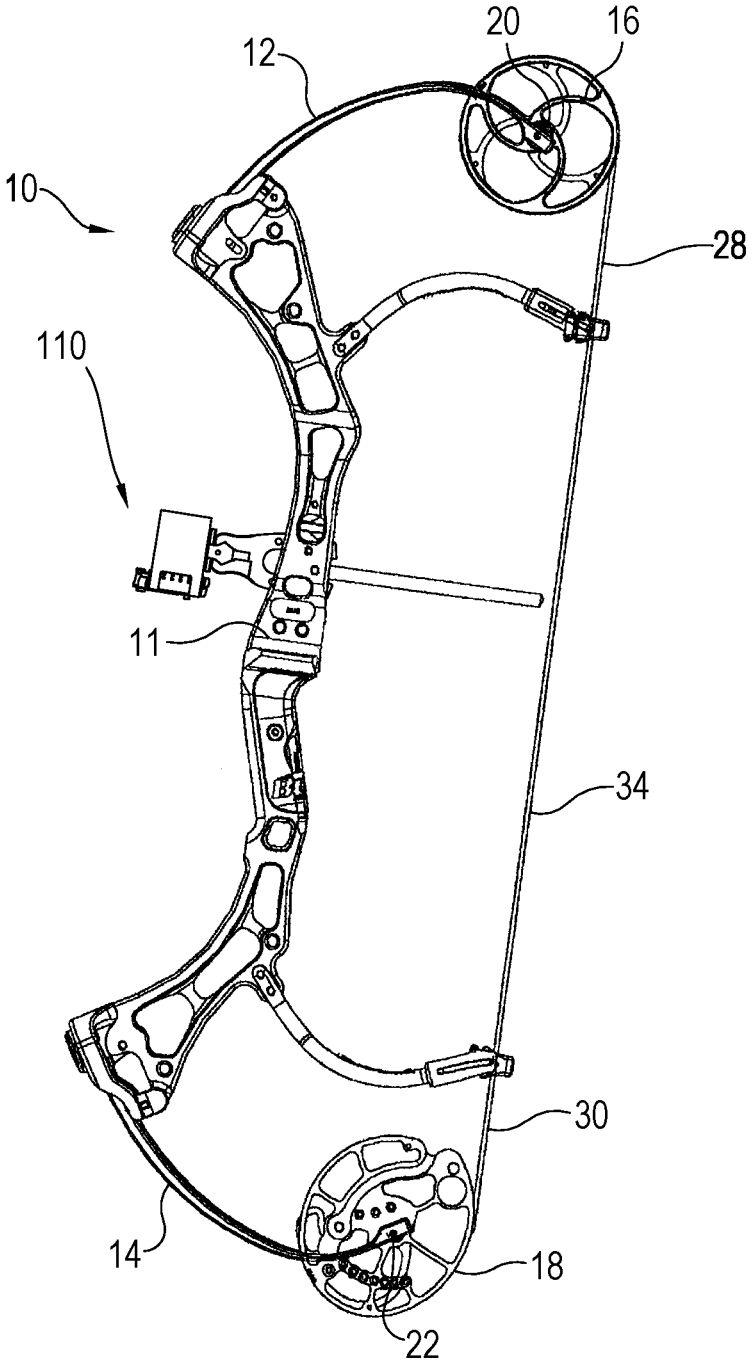
FIG. 1 is a perspective view of an archery bow including an embodiment of a sight assembly as disclosed herein.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Certain embodiments include archery bow sights which incorporate pin adjustment mechanisms which can be set to automatically arrange sight pins in appropriate proportional spacing for various target ranges based on the spacing measured for two initial points. In certain embodiments, a first pin on an archery bow sight is calibrated at a first reference distance to define a first reference point on the sight. A first alignment point on the mechanism is then calibrated to the first reference point. The bow and sight is then used at a second reference distance to determine a second reference point for a second sight pin. A second alignment point on the mechanism is then adjusted to align with the second reference point. As aligned, the mechanism defines one or more additional proportionately spaced alignment points where additional sight pins will correspond with additional reference distances.

In some embodiments, the user operates a control feature that concurrently and proportionally adjusts all of the adjustable sight pins to different heights. In other embodiments, a mechanism links the adjustable sight pins so that when a user changes the height of a single sight pin, it changes the heights of all the adjustable sight pins.

FIG. 1 illustrates one example of a conventional single cam compound archery bow generally designated as 10. When viewed from the perspective of an archer holding the bow 10, it includes a riser 11 with a handle and an arrow rest, an upper limb portion 12 and a lower limb portion 14. Rotational members forming one or two variable leverage units such as idler wheel 16 and eccentric cam 18 are supported at the limb tip sections for rotary movement about axles 20 and 22. Idler wheel 16 is carried between the outer limb tip portions of upper limb 12. The cam 18 is carried between the outer limb tip portions of lower limb 14.

Bowstring 34 (shown as a tangent line without full cabling for convenient illustration) includes upper end 28 and lower end 30 which are fed-out from idler wheel 16 and cam 18 when the bow is drawn. Bowstring 34 is mounted around idler wheel 16 and cam 18 as is known in the art. From the perspective of the archer, the bowstring is considered rearward relative to the riser which defines forward. Directional references herein are not intended to be limiting.

When the bowstring 34 is drawn, it causes idler wheel 16 and cam 18 at each end of the bow to rotate, feeding out cable and bending limb portions 12 and 14 inward, causing energy to be stored therein. When the bowstring 34 is released with an arrow engaged to the bowstring, the limb portions 12 and 14 return to their rest position, causing idler wheel 16 and cam 18 to rotate in the opposite direction, to take up the bowstring 34 and launch the arrow with an amount of energy proportional to the energy stored in the bow limbs. Bow 10 is described for illustration and context and is not intended to be limiting. The present invention can be used with dual-cam compound bows, or can be used with single-cam bows as described for example in U.S. Pat. No. 5,368,006 to McPherson, hereby incorporated herein by reference. It can also be used with hybrid cam bows or recurve bows. The present invention can also be used in other types of bows, which are considered conventional for purposes of the present invention.

Figure 2:
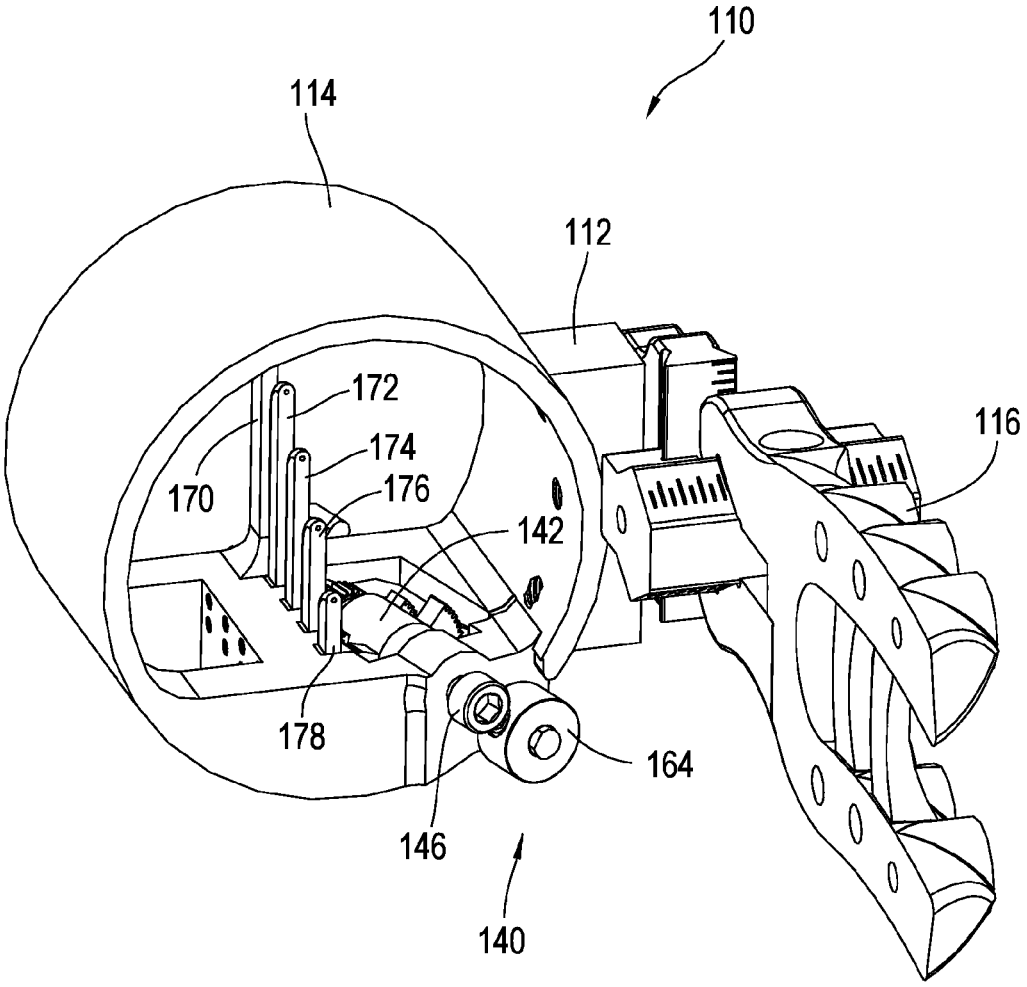
FIG. 2 is a perspective rear view of a sight assembly according to one embodiment.

FIG. 2 illustrates a perspective view of an archery sight assembly 110 according to certain embodiments of the disclosure. The sight assembly 110 includes a movable body portion or assembly, which may be attached to a rearward portion 116, for example, with windage clamps. The body assembly includes a sight block 112 from which extends a sight guard 114 which typically defines the viewing window or opening. One or more sight points are defined by one or more pins mounted to the sight block and which extend into the viewing window of sight guard 114. In certain embodiments, the one or more pins incorporate fiber optic strands to collect and deliver light to the sight point to enhance visibility. The fiber optic strands can be coiled on or adjacent the pins or the sight guard 114. Other sight features such as a battery powered sight light or a level can optionally be used with the sight guard and sight pins.

In certain embodiments, the body assembly is arranged to move or translate vertically and/or horizontally relative to rearward base portion 116. Translational movement of the body assembly correspondingly vertically or horizontally moves the entirety of the sight guard assembly and the sight pins relative to the bow riser and arrow rest. In certain embodiments, the body assembly is horizontally adjusted to horizontally calibrate the sight pins with a particular archer and bow. Separately, in certain embodiments the body assembly is vertically adjusted to vertically calibrate the bow using a first sight pin with a first reference distance to a target.

Sight pin adjustment mechanisms according to preferred embodiments herein assist an archer to calibrate a plurality of sight pins to different reference distances. For example, once the first sight pin is calibrated to a first reference distance, the bow is shot using a second sight pin at a second reference distance to calibrate the second sight pin to the second reference distance. More specifically, the bow is shot at a second reference distance and the sight pin is adjusted relative to the first sight pin to calibrate it to the selected distance. Adjustment of the second sight pin can automatically adjust one or more additional sight pins at proportionally spaced intervals to correspond to additional reference distances.

Using laws of physics and geometry, a range formula can be applied to the travel of an arrow from an archery bow where the horizontal distance traveled is proportional to the angle of launch. More specifically, a formula of:

$$x=(v^2 \sin 2\theta)/g^2$$

applies where "x" is the horizontal distance of travel, "v" is the launch velocity of the arrow from the bow, "θ" is the angle of launch and "g" is the acceleration due to gravity. Assuming a bow with a consistent launch velocity, the horizontal travel distance for a specific bow and arrow can be calculated and is proportional to the sine of twice the launch angle.

For purposes of the present mechanism, a reference or zero degree line for calculating the angle of arrow launch can be defined as a horizontal line extending from a point closely adjacent to the archer's eye, through the sight, intersecting a first sight pin and then to a target point at a first defined distance. The distance from the archer's eye to the sight pin is proportional to the draw length of the bow and is assumed to be constant for a specific archer and bow. For example, when a first sight pin on a 27" draw length bow is calibrated at 20 yards, the zero degree line can be defined as a line including approximately 27" from the archer's eye to the first sight pin plus 20 yards to a target. Using the above formula and knowing the velocity of the bow, the angles for additional reference distances such as 30, 40, 50 yards, etc. relative to the reference line and the archery's eye can also be calculated. These angles can then be applied using the distance from the archer's eye to the sight to define the offset height of additional sight pins relative to the first sight pin. Offset heights for longer distances would typically be measured downward relative to a pin calibrated for a shorter distance.

The spacing of the respective pins as calculated above follows a proportional spacing pattern governed by the range formula. Aspects of the adjustment mechanisms herein take advantage of this relationship to adjust multiple sight pins to fit the appropriate pattern for a specific archer and bow without needing to measure or know the actual distance from the archer's eye to the sight pins or the actual bow speed. Instead, those variables are assumed to be constant. Then, by adjusting the mechanism to fit two alignment points to two reference points which are already known to fit the pattern, additional properly proportionally spaced alignment points will automatically fit the pattern. In other words, sight adjustment mechanisms herein constrain multiple pins or alignment points to only adjust relative to each other in a proportional pattern governed by the range formula. Thus, if two points, such as a 20 yard point and a 60 yard point are aligned with measured actual points for 20 and 60 yards respectively, the remaining alignment points will automatically indicate the desired points for sight pins for 30, 40, 50 yards, etc.

FIGS. 2-6 illustrate a bow sight assembly 110 with an integrated adjustment mechanism 140. Sight assembly 110 includes a rearward base portion 116 mountable to a bow riser, to which a sight body assembly may be selectively vertically and horizontally mounted. Sight body assembly includes a sight block 112 and a sight guard 114.

Figure 3:
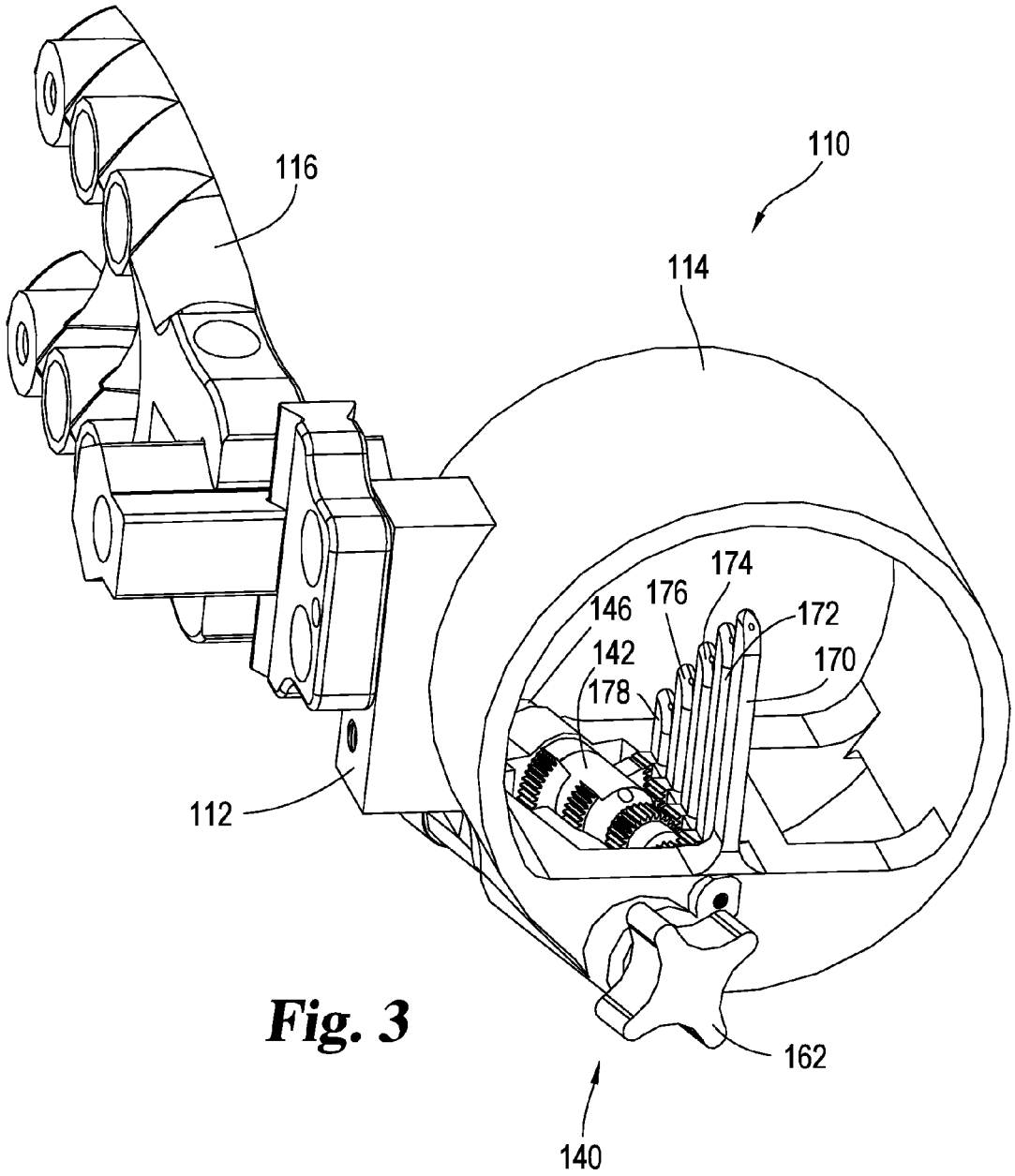
FIG. 3 is a perspective front view of a sight assembly of FIG. 2.
Figure 4:
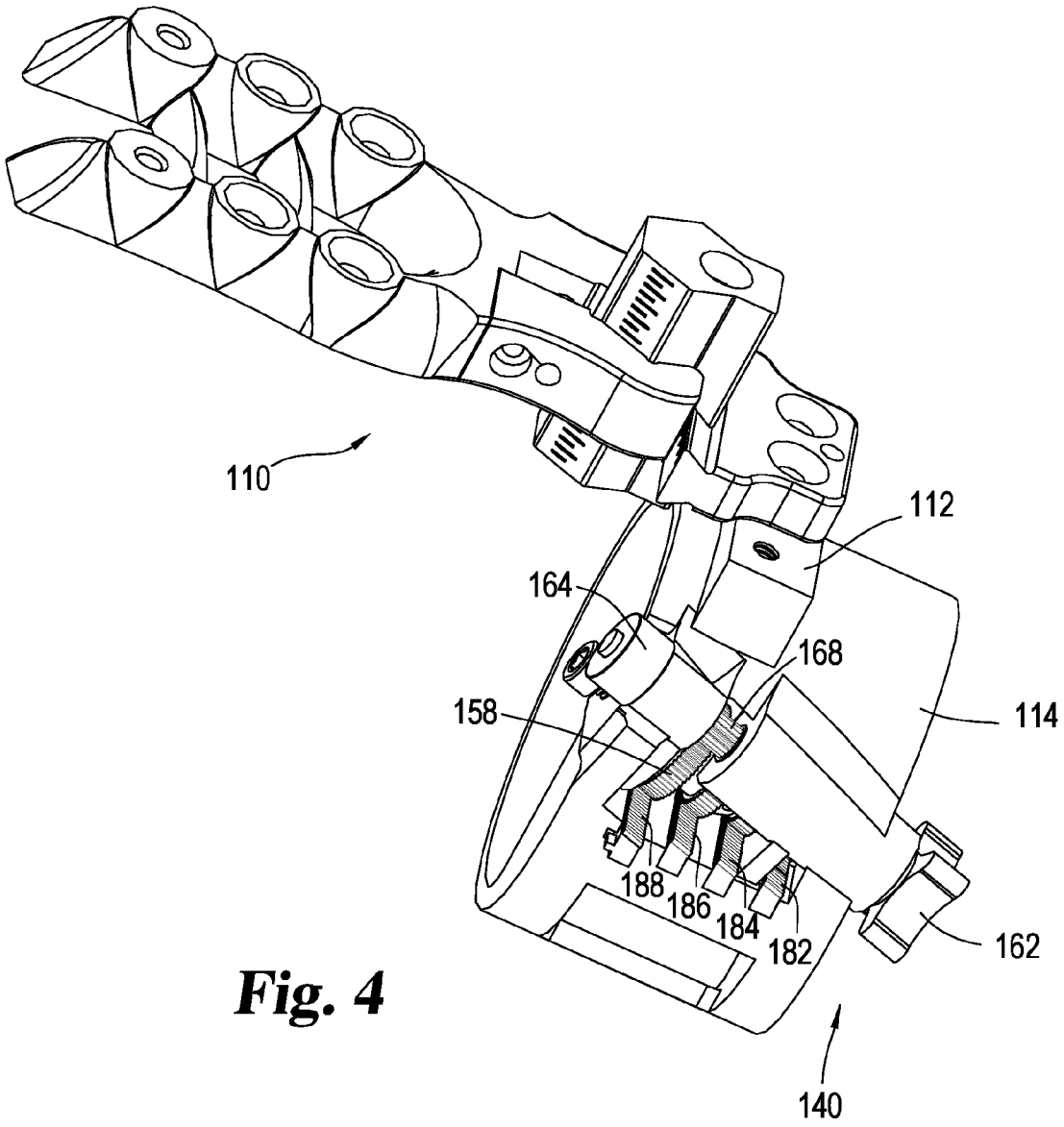
FIG. 4 is a perspective lower view of a sight assembly of FIG. 2.
Figure 5:
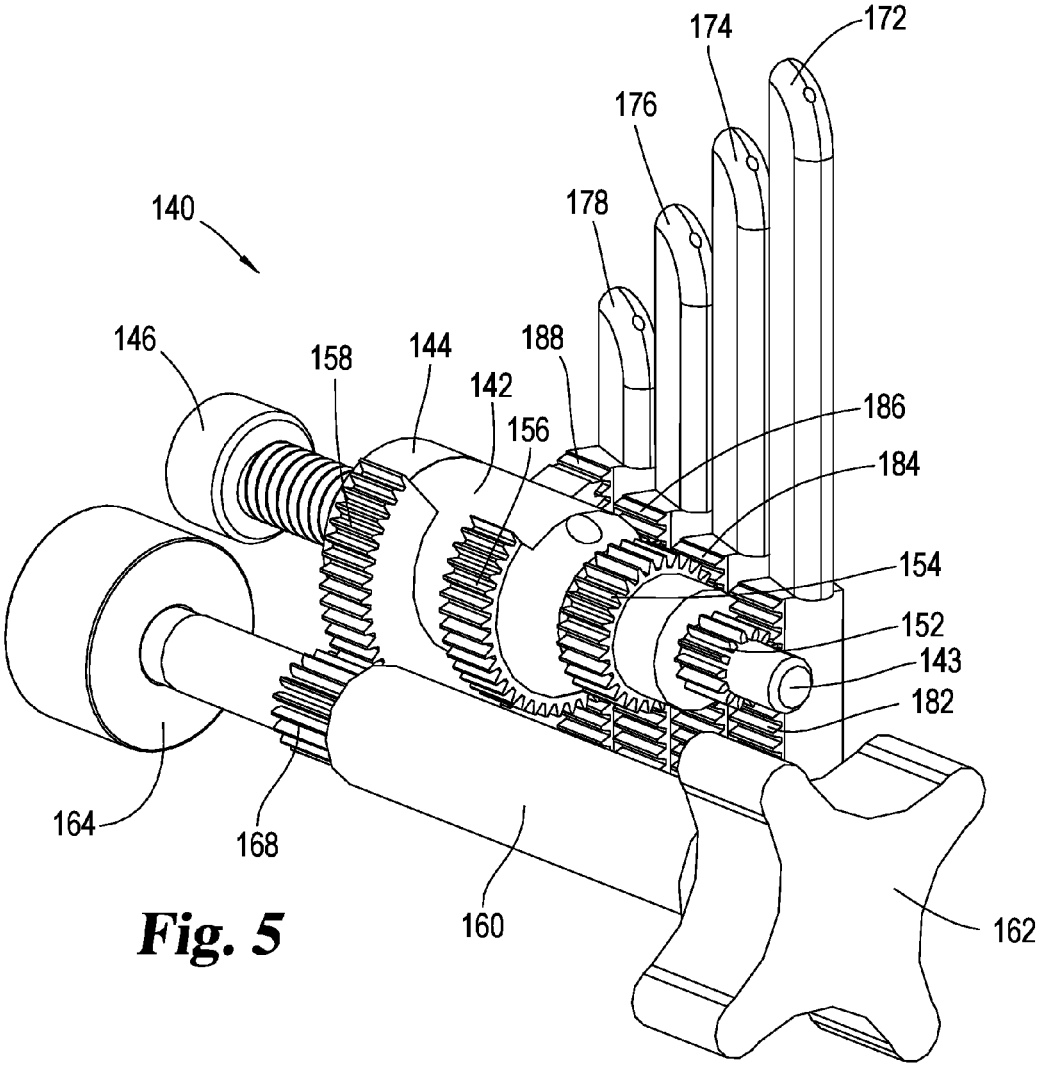
FIG. 5 is a perspective detailed view of the adjustment mechanism of FIG. 2.
Figure 6:
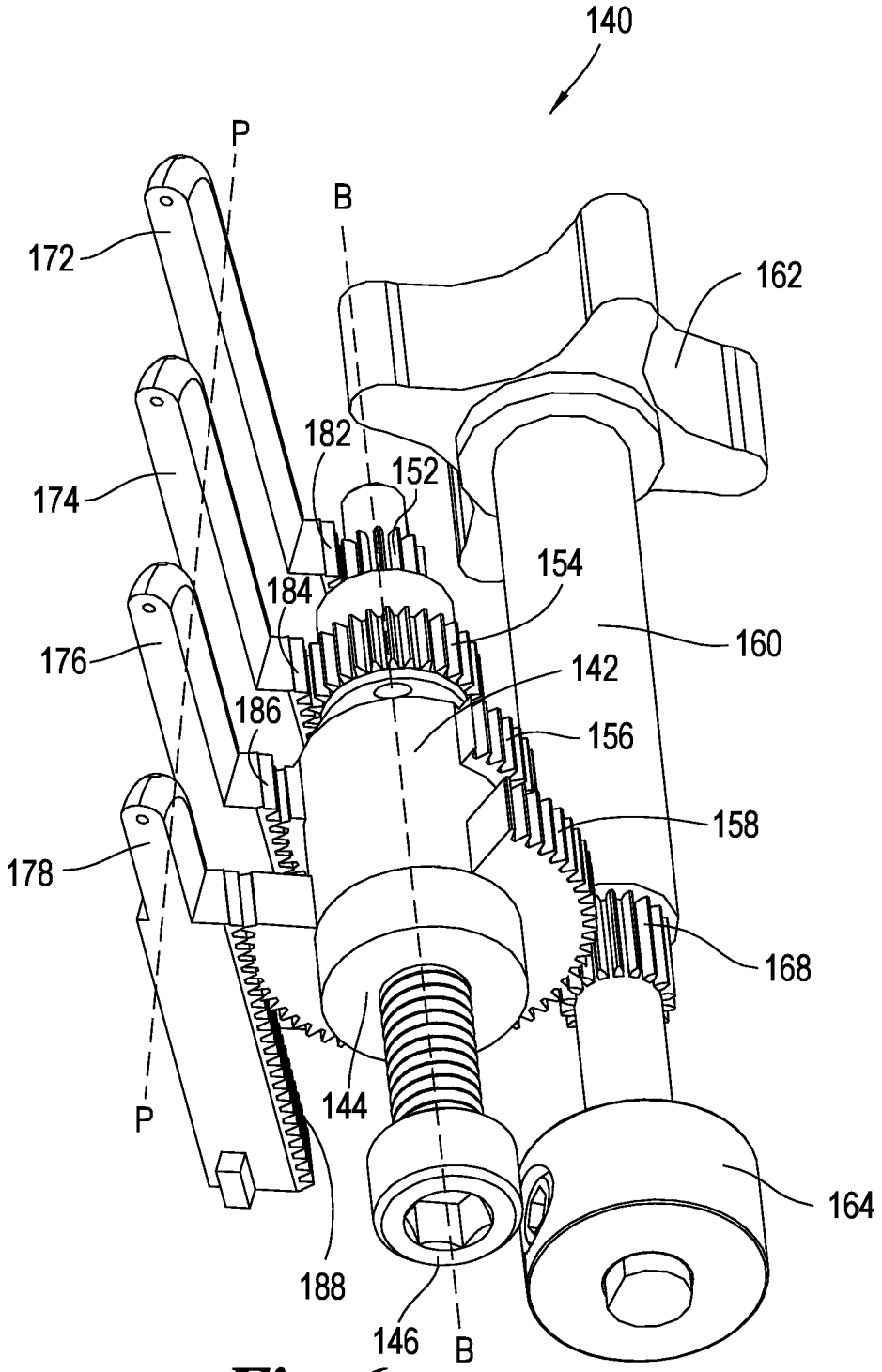
FIG. 6 is an alternate view of the adjustment mechanism of FIG. 5.

The sight body assembly includes a plurality of sight pins, such as vertically aligned pins 170, 172, 174, 176 and 178 within sight guard 114. Preferably one pin, such as the forward-most and tallest pin 170, is fixed in height relative to the sight guard, while the other pins are adjustable in height. An adjustment mechanism 140 is incorporated within sight guard 114 to selectively change the height of the adjustable pins. The adjustment mechanism 140 of FIGS. 2-4 is illustrated separately from the overall sight assembly in FIGS. 5-6 for ease of reference. In alternate embodiments, a middle or lower pin can remain fixed in height, with other pins being adjustable and with corresponding changes designed into adjustment mechanism 140, discussed below.

The adjustable pins, pins 172, 174, 176 and 178 as illustrated, are adjustable in height relative to the fixed sight pin and mounted, for example, in respective vertical channels defined in the lower portion of sight guard 114. The channels may be individual or shared, and the pins and channels may include a tab-in-slot arrangement to assist in guiding the vertical motion. The sight assembly may also include travel limits to retain the pins within the sight assembly.

Pins 172, 174, 176 and 178 are selectively controlled in height via a rack and pinion gear arrangement defined by adjustment mechanism 140. Each adjustable pin has a rack type of gear 182, 184, 186 and 188 vertically mounted on a side of the lower portion of the respective pin. The rack gears engage and are controlled by pinion gears 152, 154, 156 and 158 which are parts of pinion body 142. Preferably, the paired rack and pinion gears have matching gear tooth spacing. The pins may be formed of one or more pieces and the rack gears may be integral or separate and mounted to the pins. Alternate gear arrangements such as bevel or helical gears could also be used.

More specifically, pinion body 142 includes pinion gears of various sizes and arrangements to engage the respective rack gears. The gear tooth spacing and radius of the pinion gears is calculated and proportionally sized and spaced so that rotation of pinion body 142 a selected rotation distance correspondingly adjusts a plurality of respective sight pins with proportional height adjustments. The gearing on each pinion gear preferably extends around the circumference of pinion body 142 at least a distance sufficient to allow the respective pin to travel within its defined travel limits, but optionally the pinion gears may extend around the entire circumference of pinion body 142.

To account for the variation of radius size between different pinion gears as part of pinion body 142, the rotation axis B-B of pinion body 142 is angled so it is non-parallel relative to the forward to rearward axis P-P along which pins 170-178 are aligned. The axis B-B of pinion body 142 is closer to the axis of the pins P-P where the smallest pinion gear 152 engages rack gear 182, and the pinion body axis B-B is further from the axis of the pins P-P where the largest pinion gear 158 engages rack gear 188. Preferably the rack gears 182-188 on the sides of pins 172-178 are mounted at a slight angle from the axis P-P of the pins and parallel to pinion body axis B-B to maintain the desired perpendicular engagement between the respective rack and pinion gears.

Pinion body 142 may be made integrally with the respective pinion gear portions machined, cast or otherwise formed around axis B-B. Alternately, pinion body 142 may be formed of a common axle with one or more pinion gears mounted along the length of the axle and keyed to turn in conjunction with rotation of the axle. In the illustrated embodiment, pinion body 142 includes an end portion 143 rotationally mountable within a corresponding journal in sight guard 114. The opposing end of the illustrated pinion body 142 is engaged by a mounting screw 146 which extends through a bore into sight guard 114 to engage the pinion body while allowing the pinion body to rotate. Optionally screw 146 rotates in conjunction with rotation of pinion body 142. Optionally, a spacer 144 may be arranged between body portion 142 and the sight housing and screw. Appropriate bushings may be used.

Adjustment mechanism 140 may be selectively controlled by an archer using control knob 162. In the illustrated embodiment, control knob 162 is shown on the forward side of sight 110, but alternately it could be on the rear side. Control knob 162 is part of or connected to one end of control shaft 160. Control shaft 160 extends through sight guard 114 along an axis parallel to body portion axis B-B. The opposing end of control shaft 162 is rotatable secured or retained relative to the housing using a fastener 164.

A control gear 168 is arranged along the length of control shaft 160 and is aligned with the rotational axis of the shaft. The rotation of control gear 168 corresponds to and is controlled by rotation of knob 162 and shaft 160. Control gear 168 engages one of the pinion gears of pinion body 142, in the illustrated example control gear 168 engages pinion gear 158. Correspondingly, rotation of control gear 168 rotates pinion gear 158. The controlled rotation of pinion gear 158 controllably rotates pinion body 142 such that each of the pinion gears 152-158 controllably and correspondingly rotates and moves the corresponding rack gears 182-188 to change the heights of corresponding pins 172-178. The proportional height spacing of pins 172-178 is controlled by the proportional gearing and radius of the respective rack and pinion gear arrangements between pinion body 142 and the pins.

In use, the sight assembly 110 is adjusted so that first pin 170, or alternately a selected pin of fixed height, is calibrated to a first distance. The adjustment mechanism 140 is then used to adjust a second pin to a second distance. As the second pin is adjusted, the other adjustable sight pins are concurrently and proportionally adjusted to different heights. After correctly aligning the first and second pins, the remaining pins will already be adjusted to corresponding distances.

FIGS. 7-11 illustrate a bow sight assembly 210 with an integrated adjustment mechanism 240. Sight assembly 210 includes a rearward base portion 216 mountable to a bow riser, to which a sight body assembly may be selectively vertically and horizontally mounted. Sight body assembly includes a sight block 212 and a sight guard 214.

Figure 7:
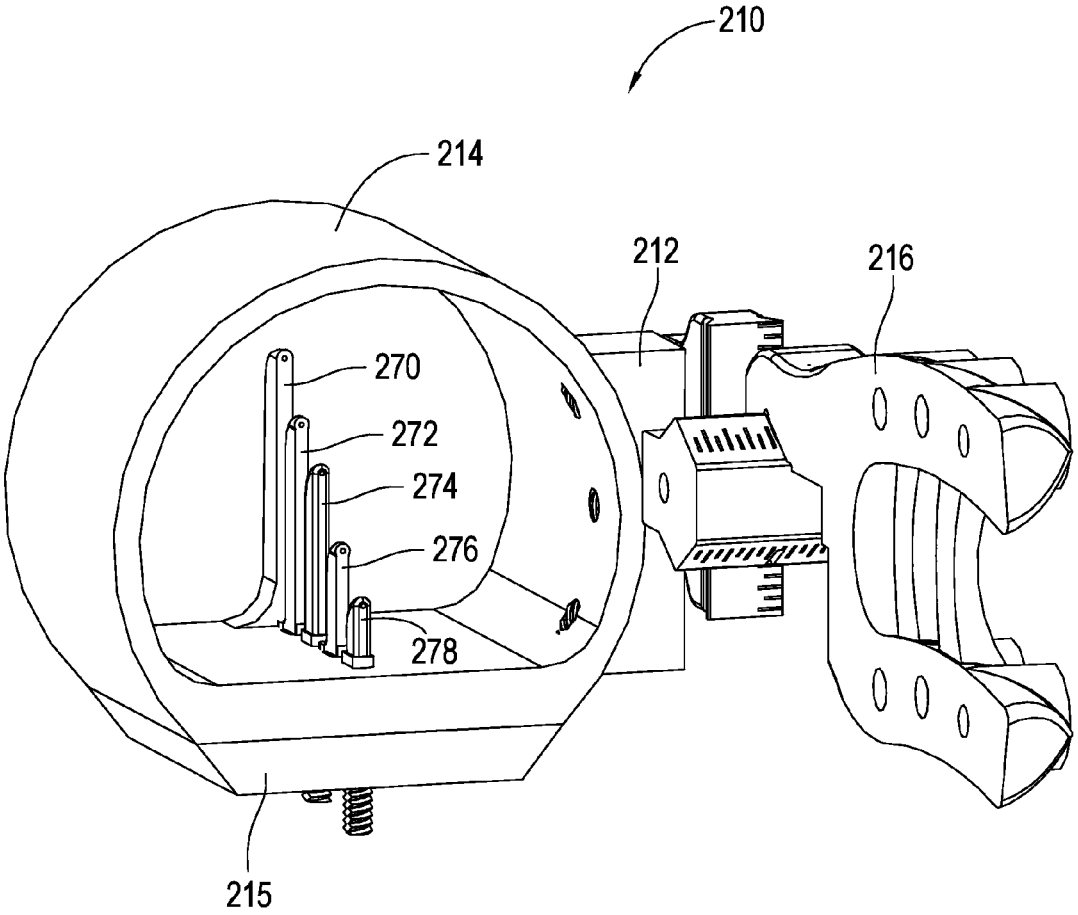
FIG. 7 is a perspective rear view of a sight assembly according to an alternate embodiment.
Figure 8:
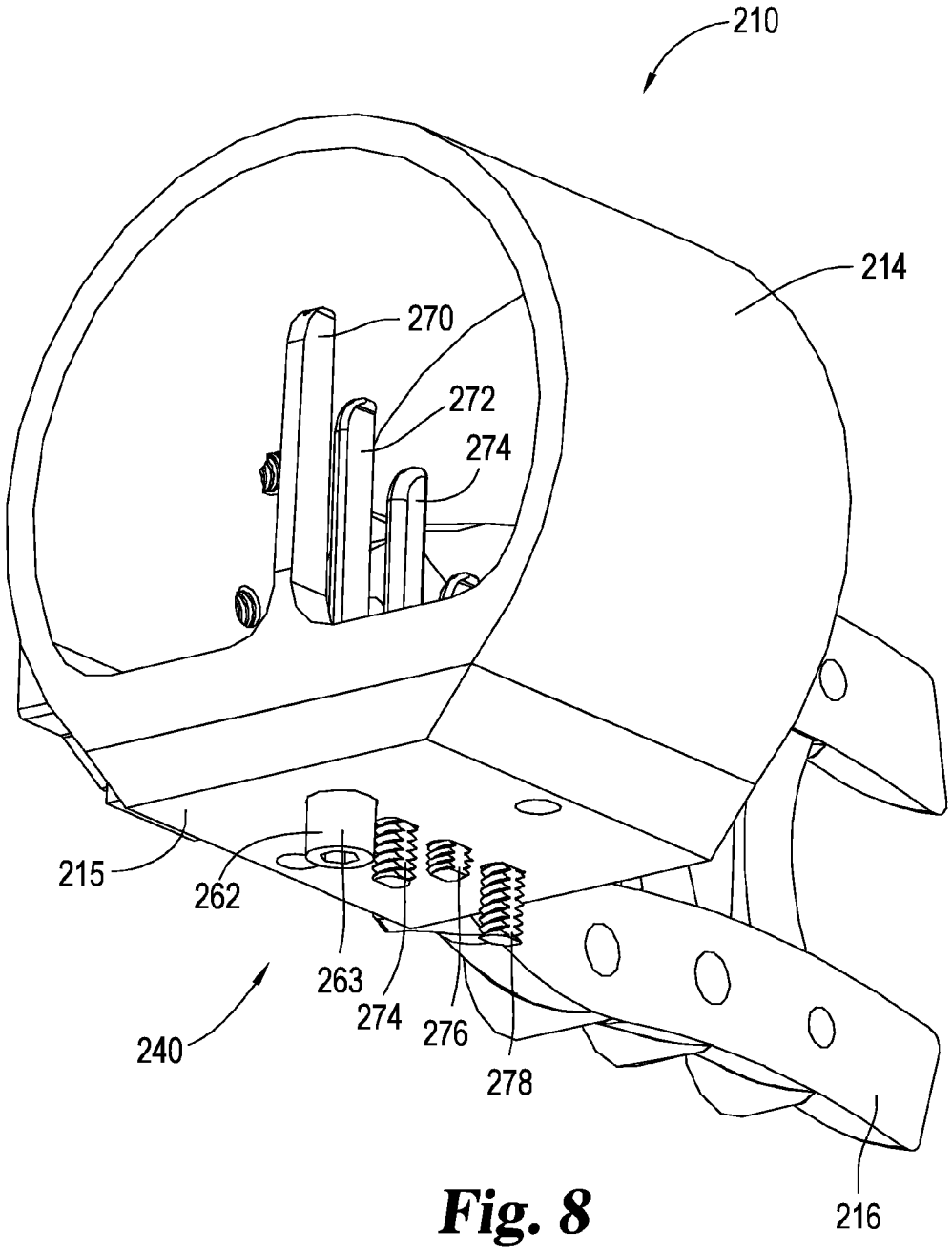
FIG. 8 is a perspective lower, front view of a sight assembly of FIG. 7.
Figure 9:
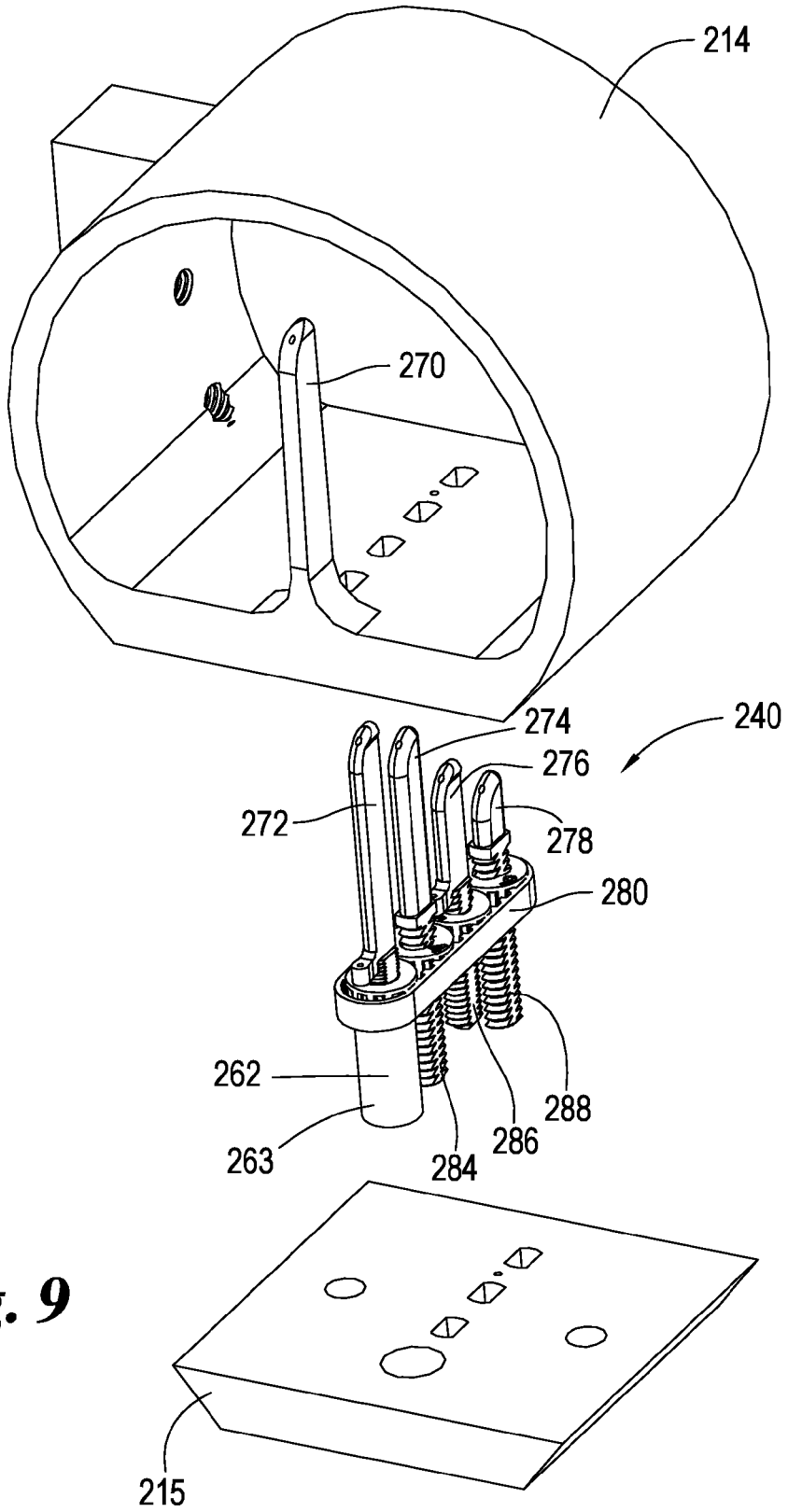
FIG. 9 is an exploded view of the sight guard assembly of FIG. 7.
Figure 10:
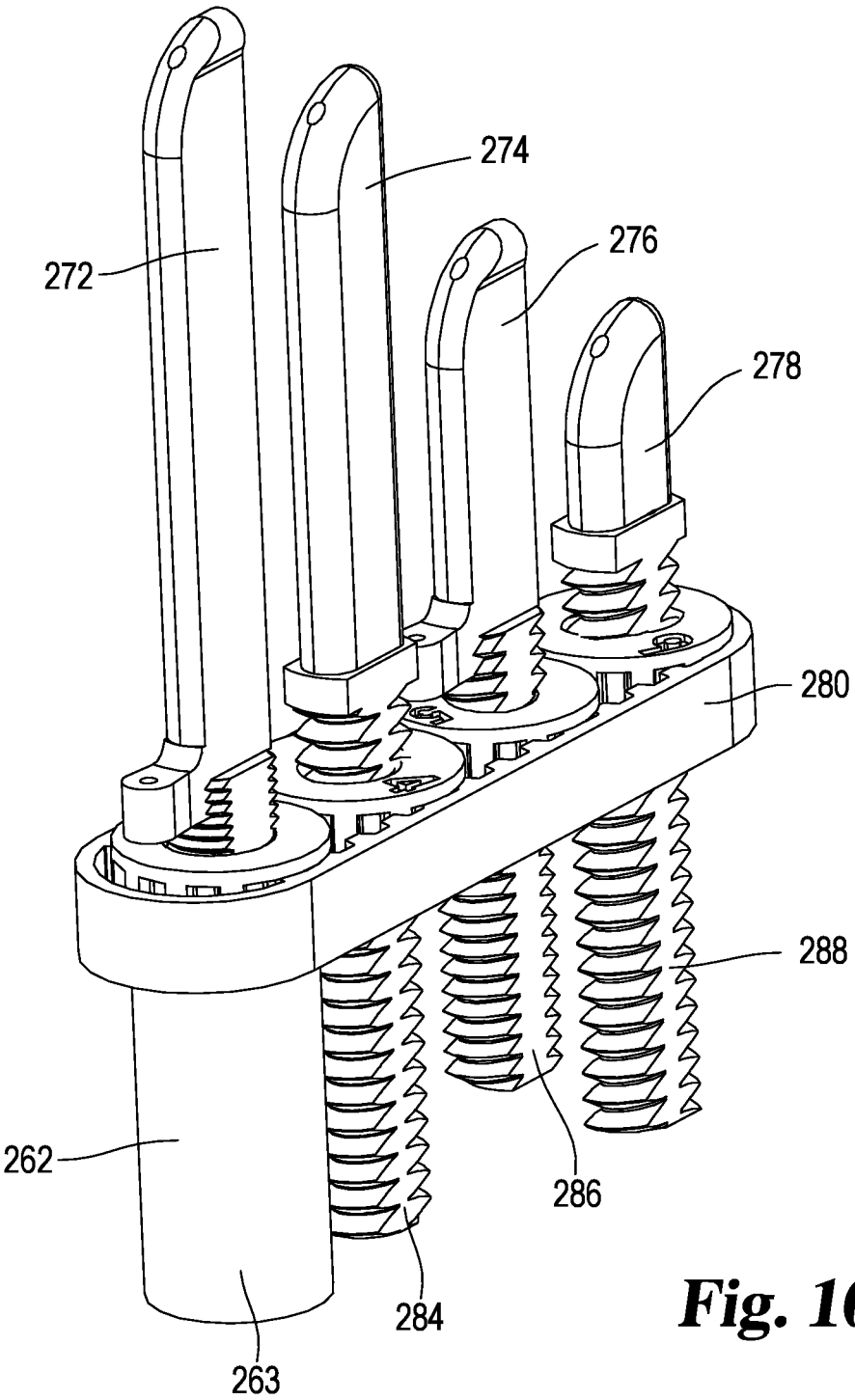
FIG. 10 is a detailed view of the adjustment mechanism of FIG. 7.
Figure 11:
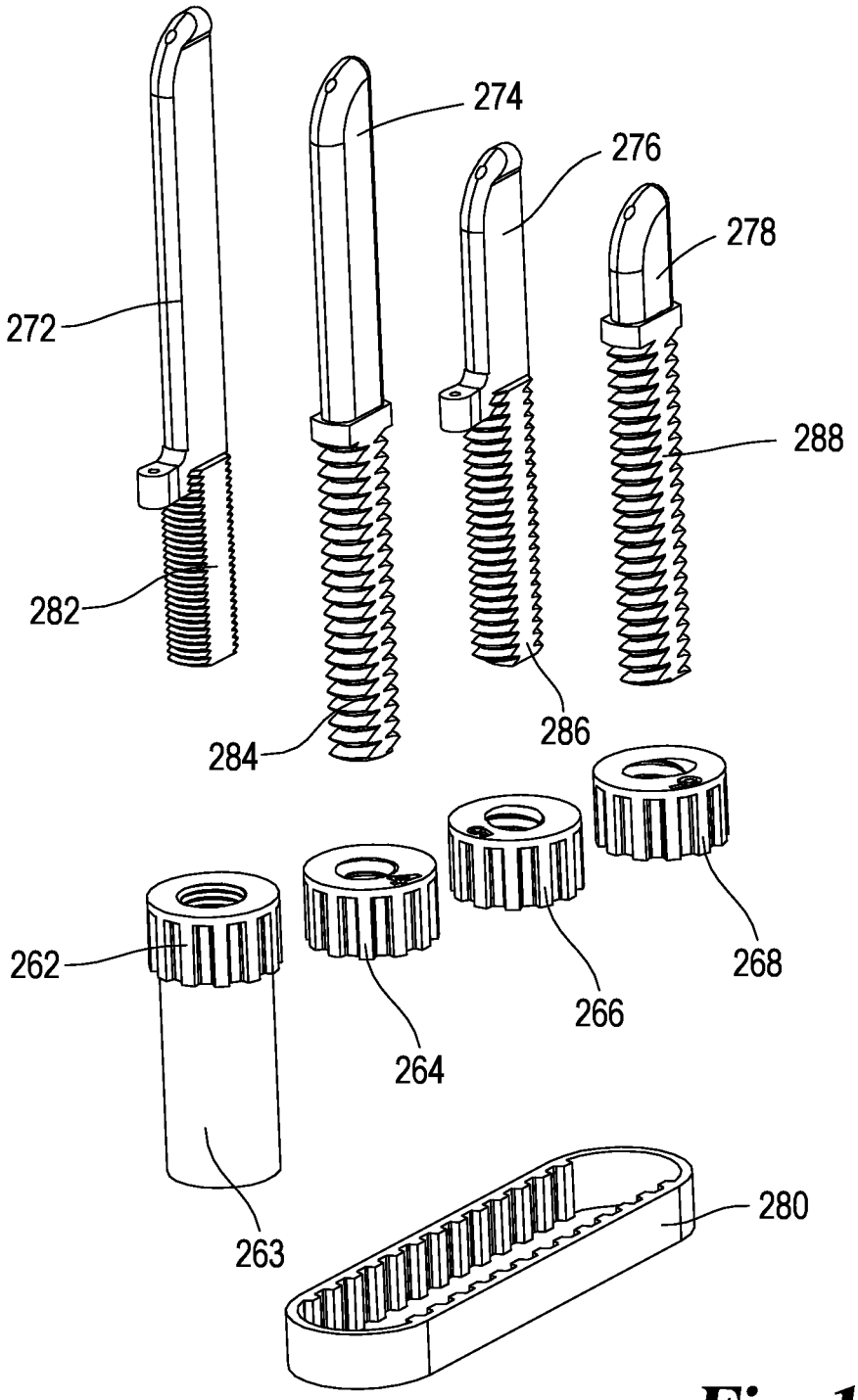
FIG. 11 is an exploded view of the adjustment mechanism of FIG. 10.

The sight body assembly includes a plurality of sight pins, such as vertical pins 270, 272, 274, 276 and 278 mounted within sight guard 214. Preferably one pin, such as the forward-most and tallest pin 270, is fixed in height relative to the sight guard, while the other pins are adjustable in height. An adjustment mechanism 240 is incorporated within sight guard 214 to selectively change the height of the adjustable pins. The adjustment mechanism 240 of FIGS. 7-9 is illustrated separately from the overall sight assembly in FIGS. 10-11 for ease of reference. In alternate embodiments, a middle or lower pin can remain fixed in height, with other pins being adjustable and with corresponding changes designed into adjustment mechanism 240, discussed below.

The adjustable pins, pins 272, 274, 276 and 278 as illustrated, are adjustable in height and mounted, for example, in respective vertical channels defined in the lower portion of sight guard 214. The channels may be individual or shared, and the pins and channels may include a tab-in-slot arrangement to assist in guiding the vertical motion. The sight assembly may also include travel limits to retain the pins within the sight assembly.

Adjustment mechanism 240 may be mounted within a cavity defined between the lower portion of sight guard 214 and bottom cover 215. Bottom cover 215 is attachable to the lower portion of the sight guard 214 and secures adjustment mechanism 240 between the bottom cover and the sight guard.

Adjustable pins 272, 274, 276 and 278 are selectively controlled in height via a timing belt and gearing arrangement defined by adjustment mechanism 240. Each adjustable pin has a corresponding rotatable nut portion 262, 264, 266 and 268. Outer gear tracks on the exterior of the nut portions are engaged and driven by inner gearing of timing belt 280 which links together the adjustable pins. Each nut portion has an interior threaded bore to engage lower threaded portions 282, 284, 286 and 288 of the respective sight pins. The pins may be formed of one or more pieces.

Preferably, the nut portions and the pin threaded portions have matching/mating threads. More specifically, the pairs of nut portions and pin threaded portions have matching/mating threading of differing proportional size and pitch so that rotation of a nut portion a selected rotation distance adjusts the respective sight pin with a corresponding proportional height adjustment. Further, rotation of all of the nut portions a selected rotation distance concurrently will adjust the pin heights by different yet proportionally related distances.

Adjustment mechanism 240 may be selectively controlled by an archer using a control knob 263. In the illustrated embodiment, control knob 263 is a lower portion of control nut 262 which extends downward and is accessible through bottom cover 215. The control knob 263 can be selectively rotated manually, for example with a user's hand, or with a tool such as a hex or Allen wrench.

The rotation of control knob 263 correspondingly rotates the first nut portion 262. Rotation of first nut portion 262 rotates timing belt 280 and also adjusts the height of sight pin 272. The rotation of timing belt 280 controllably rotates the remaining control nuts 264-268 to change the height of corresponding pins 274-278. The proportional height spacing of pins 272-278 is controlled by the proportional threading between the matched control nuts 262-268 and lower pin portions 282-288.

In use, the sight assembly 210 is adjusted so that first pin 270, or alternately a selected pin of fixed height, is calibrated to a first distance. The adjustment mechanism 240 is used to adjust a second pin to a second distance. After correctly aligning the first and second pins, the remaining pins will already be adjusted to corresponding distances.

Figure 12:
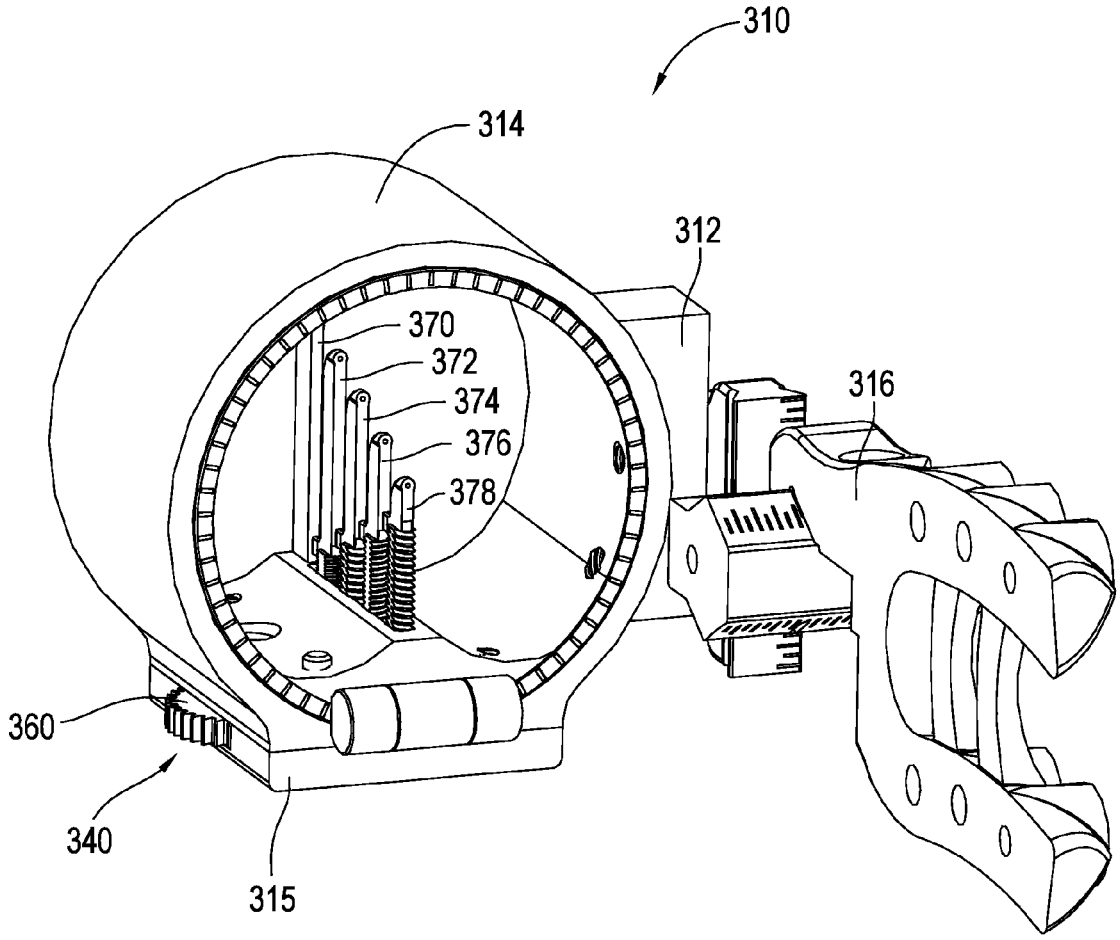
FIG. 12 is a perspective rear view of an alternate sight assembly embodiment.
Figure 13:
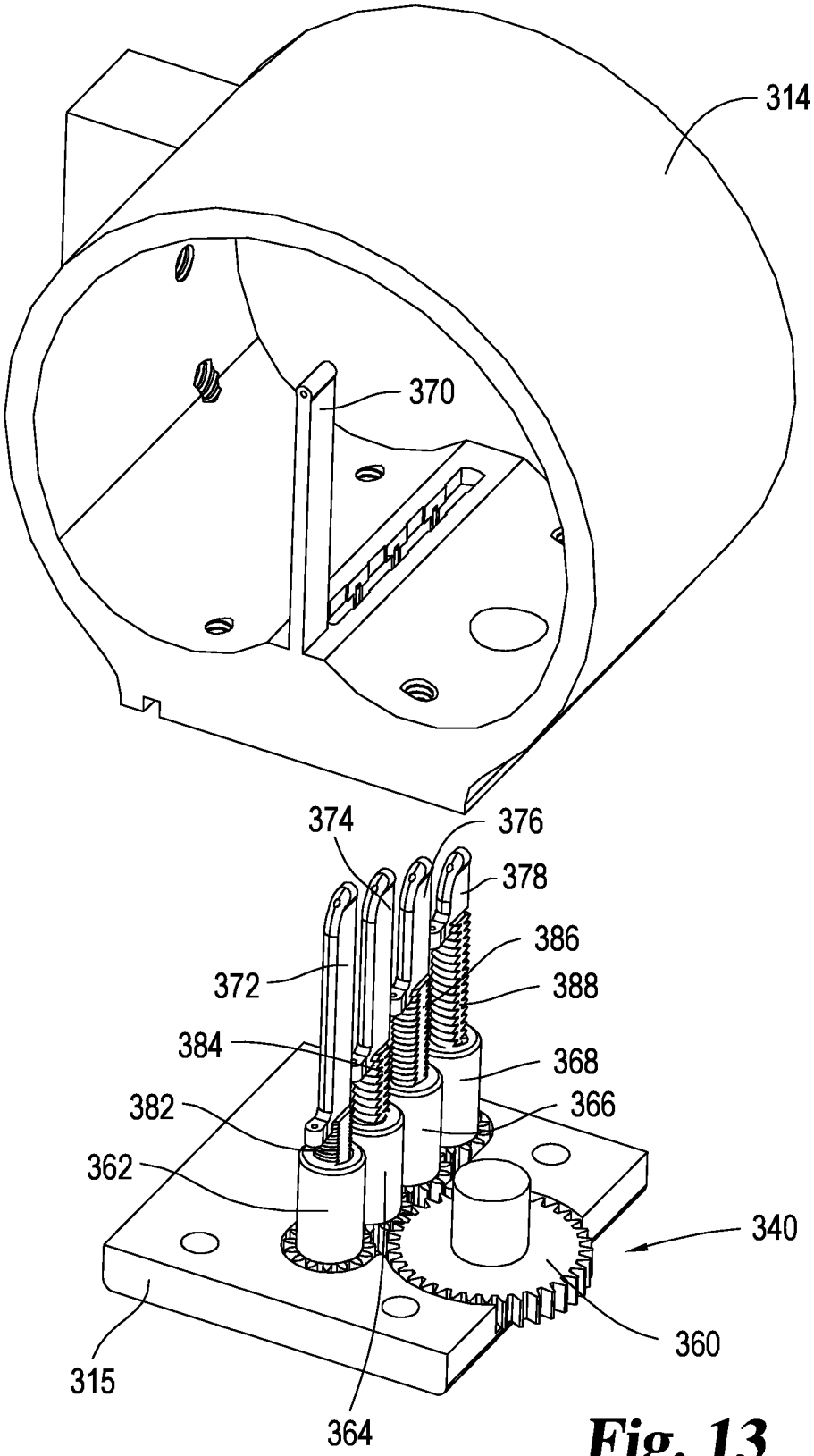
FIG. 13 is an exploded view of the sight guard assembly of FIG. 12.
Figure 14:
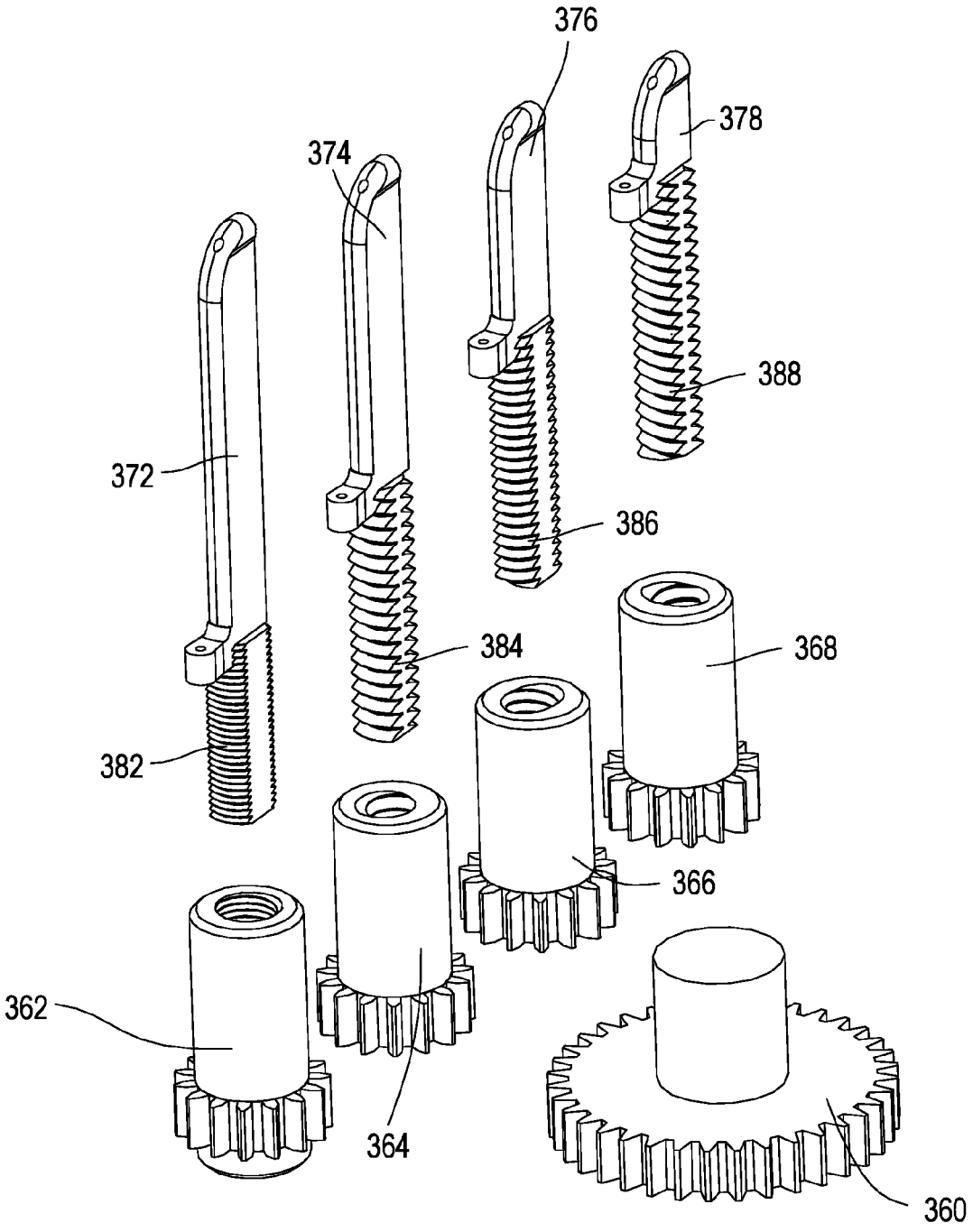
FIG. 14 is an exploded view of the adjustment mechanism of FIG. 12.

FIGS. 12-14 illustrate an alternate bow sight assembly 310 with an integrated adjustment mechanism 340. Sight assembly 310 includes a rearward base portion 316 mountable to a bow riser, to which a sight body assembly may be selectively vertically and horizontally mounted. Sight body assembly includes a sight block 312 and a sight guard 314.

The sight body assembly includes a plurality of sight pins, such as vertical pins 370, 372, 374, 376 and 378 mounted within sight guard 314. Preferably one pin, such as the forward-most and tallest pin 370, is fixed in height relative to the sight guard, while the other pins are adjustable in height. An adjustment mechanism 340 is incorporated within sight guard 314 to selectively change the height of the adjustable pins. The adjustment mechanism 340 of FIGS. 12-13 is illustrated separately from the overall sight assembly in FIG. 14 for ease of reference. In alternate embodiments, a middle or lower pin can remain fixed in height, with other pins being adjustable and with corresponding changes designed into adjustment mechanism 340, discussed below.

The adjustable pins, pins 372, 374, 376 and 378 as illustrated, are adjustable in height and mounted, for example, in respective vertical channels defined in the lower portion of sight guard 314. The channels may be individual or shared, and the pins and channels may include a tab-in-slot arrangement to assist in guiding the vertical motion. The sight assembly may also include travel limits to retain the pins within the sight assembly.

Adjustment mechanism 340 may be mounted within a cavity defined between a lower portion of sight guard 314 and a bottom cover 315, for example in a cavity formed in the bottom cover. Bottom cover 315 is attachable to the lower portion of the sight guard 314 and secures adjustment mechanism 340 between the bottom cover and the sight guard.

Adjustable pins 372, 374, 376 and 378 are selectively controlled in height via a gear train arrangement defined by adjustment mechanism 340. Each adjustable pin is matched with a corresponding rotatable base 362, 364, 366 and 368. Outer gear teeth on the exterior of the bases engage each other in series and are driven by the gearing of a control gear 360. The outer gear teeth are illustrated as being the same size, but alternately bases with differing radius and gear pitch could be used. Each rotatable base has an interior threaded bore to engage lower threaded portions 382, 384, 386 and 388 of the respective sight pins. The pins may be formed of one or more pieces.

Preferably, the rotatable bases 362-368 and the pin threaded portions 382-388 have matching/mating threads. More specifically, the matched pairs of bases and pin threaded portions have matching/mating threading of differing proportional size and pitch so that rotation of a base portion a selected rotation distance adjusts the respective sight pin with a corresponding proportional height adjustment. Further, rotation of all of the bases a selected rotation distance concurrently will adjust the pin heights by different yet proportionally related distances.

Adjustment mechanism 340 may be selectively controlled by an archer using a control gear 360. In the illustrated embodiment, control gear 360 is a rotatable gear which extends laterally outward and which is accessible through a side of bottom cover 315. The control gear 360 can be selectively rotated manually by hand or from the side or bottom with a tool such as a hex or Allen wrench.

The gear teeth on control gear 360 engage the outer gear teeth of one of the rotatable bases, for example gear base 364. The rotation of control gear 360 correspondingly rotates gear base 364. The rotation of gear base 364 further controllably and correspondingly rotates the adjacent gear bases 362 and 366. The rotation of gear base 366 communicates the rotation and correspondingly rotates gear base 368. Rotation of gear bases 362-368, via their internal threading, changes the height of corresponding pins 374-378. The height spacing of pins 372-378 is controlled by the proportional threading between the matched bases and lower pin portions. The gear train arrangement will cause adjacent bases to rotate in alternating clockwise/counter-clockwise directions. Correspondingly, the internal threading on adjacent bases and lower pin portions is made in alternating directions.

In use, the sight assembly 310 is adjusted so that first pin 370, or alternately a selected pin of fixed height, is calibrated to a first distance. The adjustment mechanism 340 is used to adjust a second pin to a second distance. After correctly aligning the first and second pins, the remaining pins will already be adjusted to corresponding distances.

FIGS. 15-21 illustrate a bow sight assembly 410 with an integrated adjustment mechanism 420. Sight assembly 410 includes a rearward base portion 416 mountable to a bow riser, to which a sight body assembly may be selectively vertically and horizontally mounted. Sight body assembly includes a sight block 412 and a sight guard 414.

Figure 15:
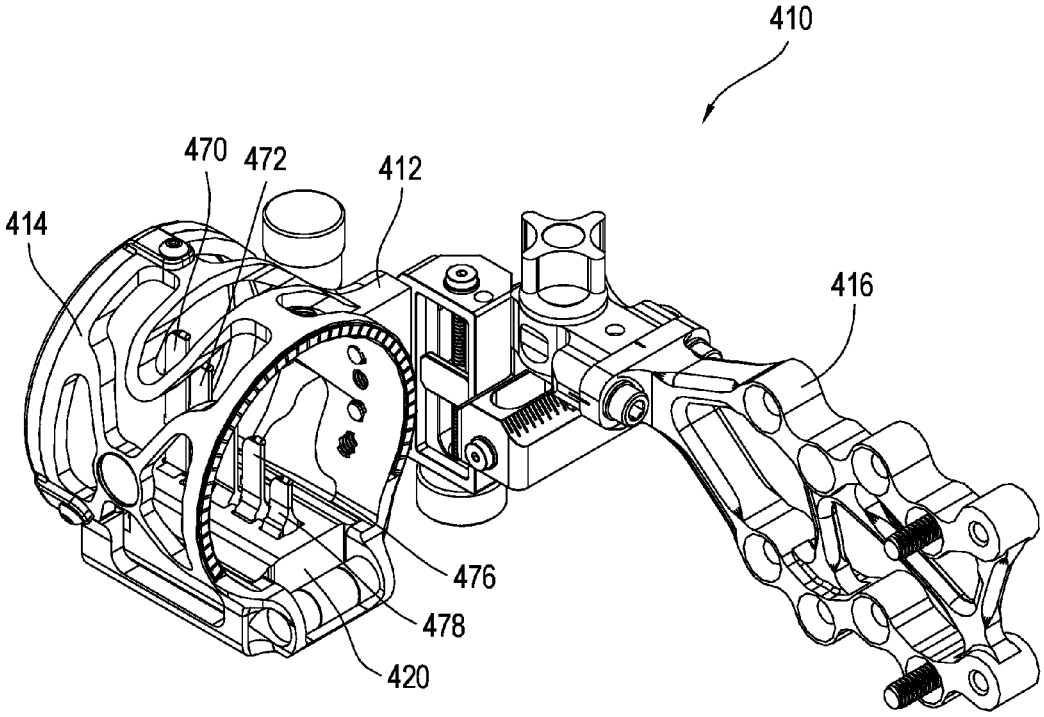
FIG. 15 is a perspective rear view of a sight assembly according to an alternate embodiment.
Figure 16:
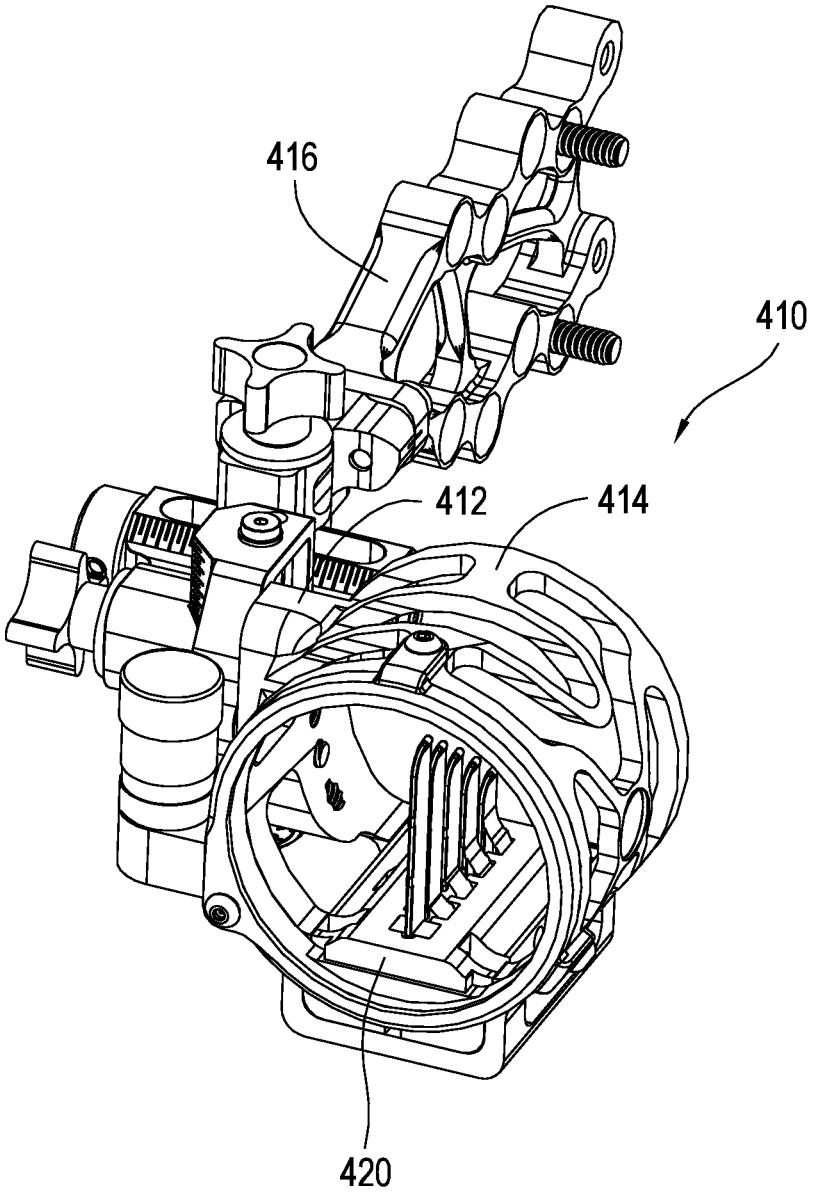
FIG. 16 is a perspective front view of the sight assembly of FIG. 15.
Figure 17:
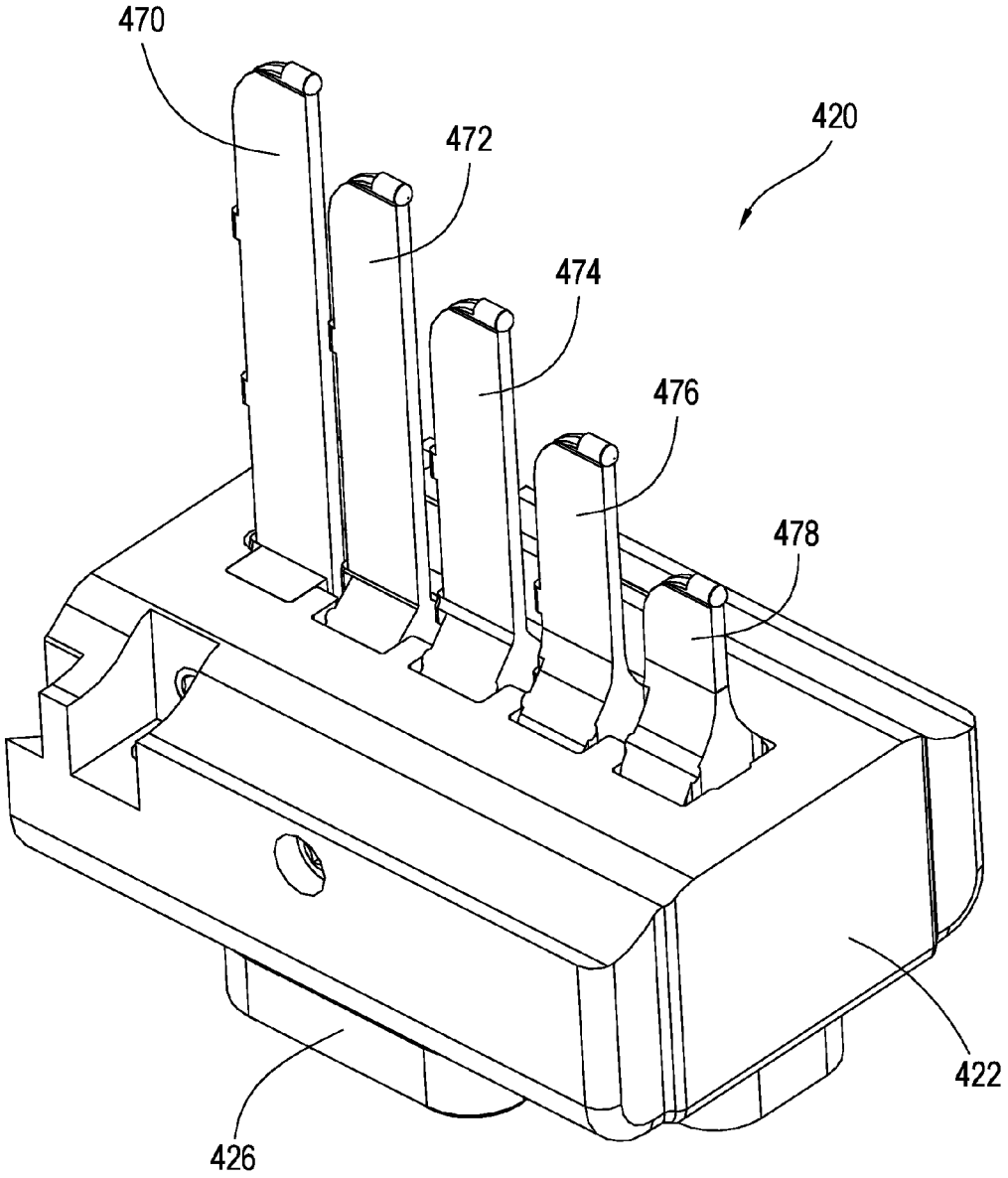
FIG. 17 is a view of the adjustment mechanism of FIG. 15.
Figure 18:
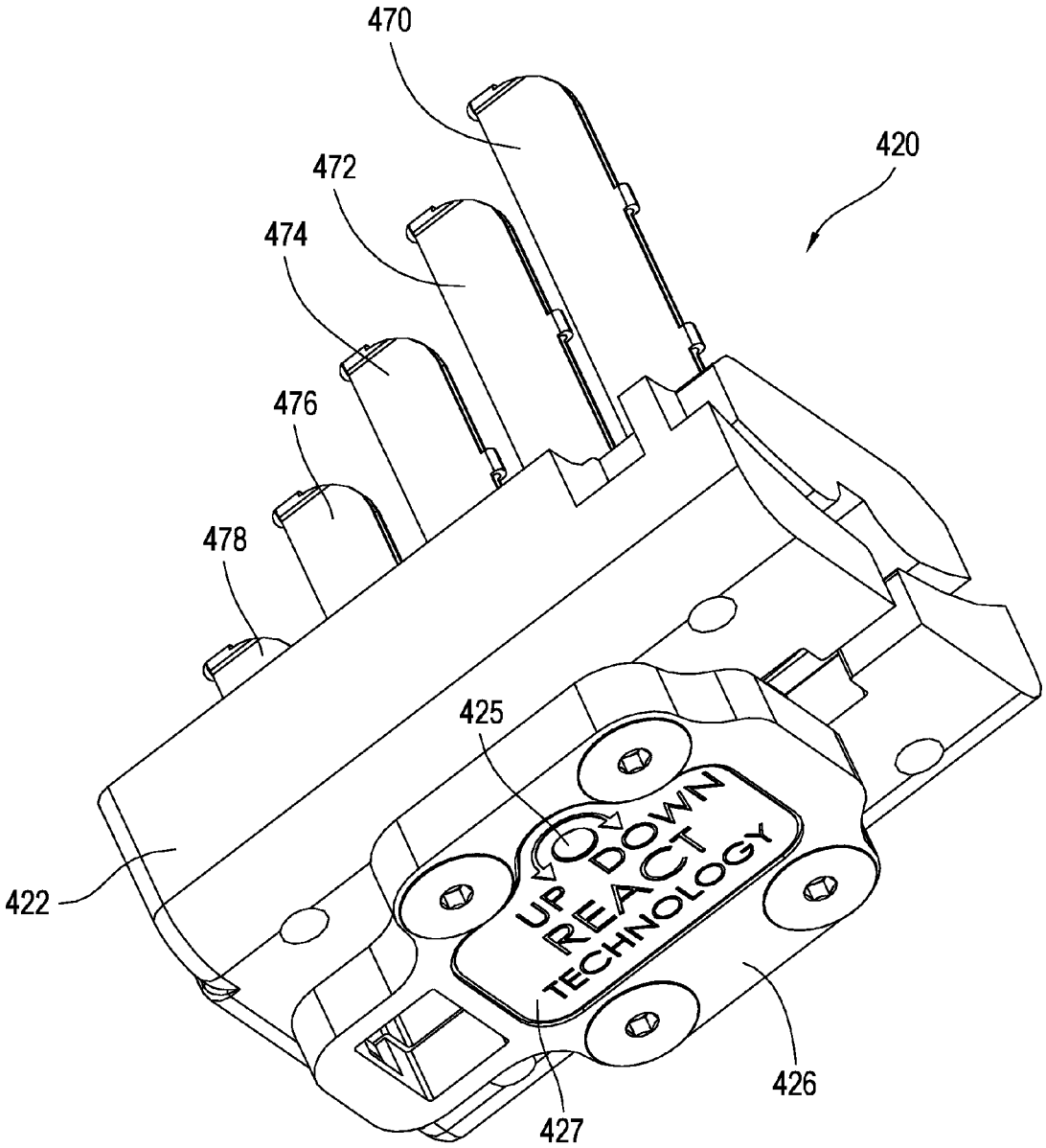
FIG. 18 is a lower view of the adjustment mechanism of FIG. 17.

The sight body assembly includes a plurality of sight pins, such as vertical pins 470, 472, 474, 476 and 478 mounted within sight guard 414. Preferably one pin, such as the forward-most and tallest pin 470, is fixed in height relative to the sight guard, while the other pins are adjustable in height. An adjustment mechanism 420 is incorporated within sight guard 414 to selectively change the height of the adjustable pins. The adjustment mechanism 420 of FIGS. 15-16 is illustrated separately from the overall sight assembly in FIGS. 17-21 for ease of reference. In alternate embodiments, a middle or lower pin can remain fixed in height, with other pins being adjustable and with corresponding changes designed into adjustment mechanism 420, discussed below.

The adjustable pins, pins 472, 474, 476 and 478 as illustrated, are adjustable in height and mounted, for example, in respective vertical channels defined in adjustment mechanism 420. The channels may be individual or shared, and the pins and channels may include a tab-in-slot arrangement to assist in guiding the vertical motion. The sight assembly may also include travel limits to retain the pins within the sight assembly.

A portion of adjustment mechanism 420 may be formed integrally as part of the sight guard assembly or can be separate and mounted to the sight guard assembly. The adjustment mechanism 420 includes an upper cover 422 and a bottom cover 426 which define an upper internal cavity 424 and a lower internal cavity 428. An adjustment screw opening 425 is defined upwardly through the bottom cover 426. Optionally a portion of the bottom cover may be marked with indicia such as directions or identifying information. In certain embodiments a sticker 427 is used to mark bottom cover 426. Bottom cover 426 is secured to the upper cover 422, for example with four screws.

Figure 19:
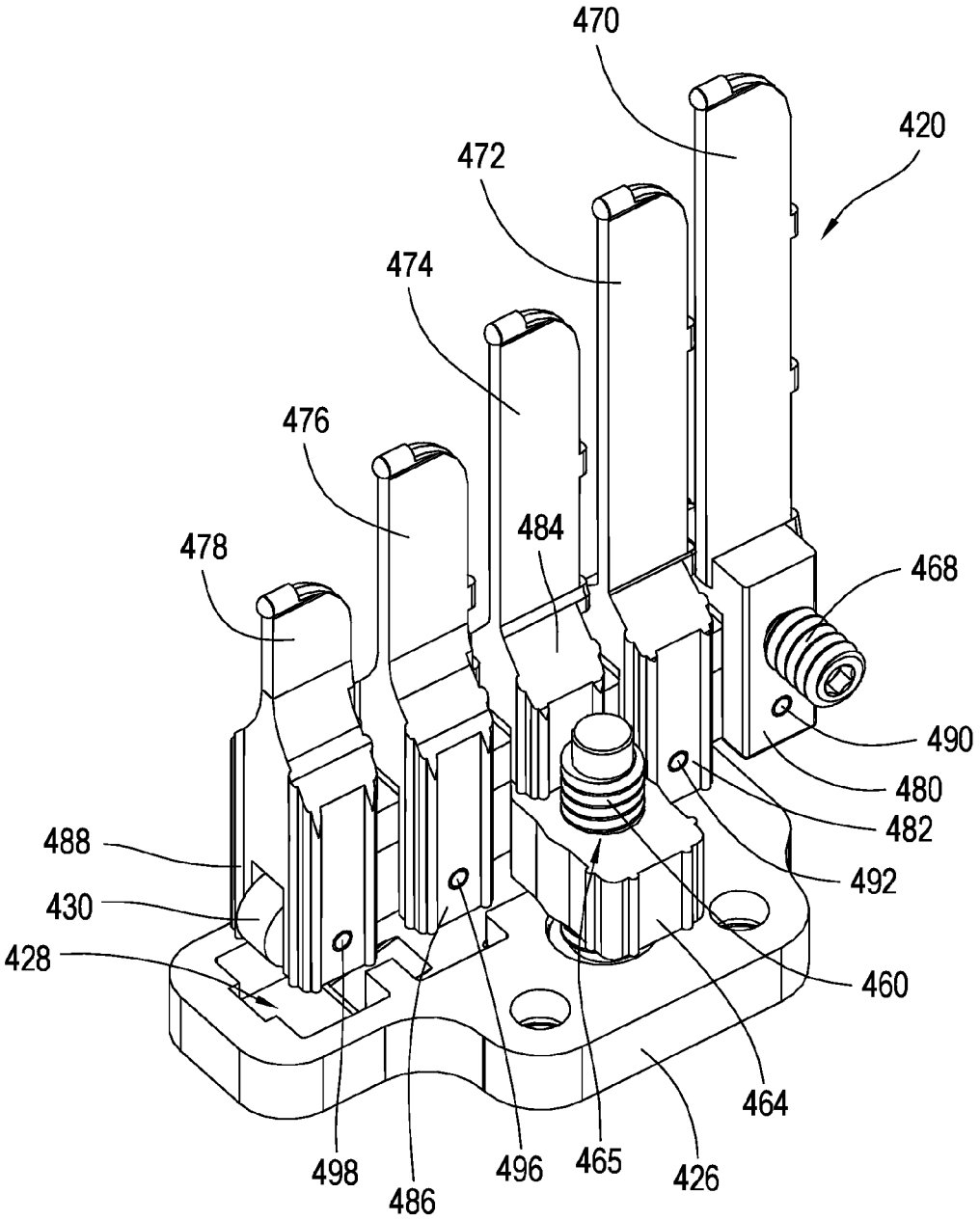
FIG. 19 is a partial interior view of the components of the adjustment mechanism of FIG. 15.
Figure 20:
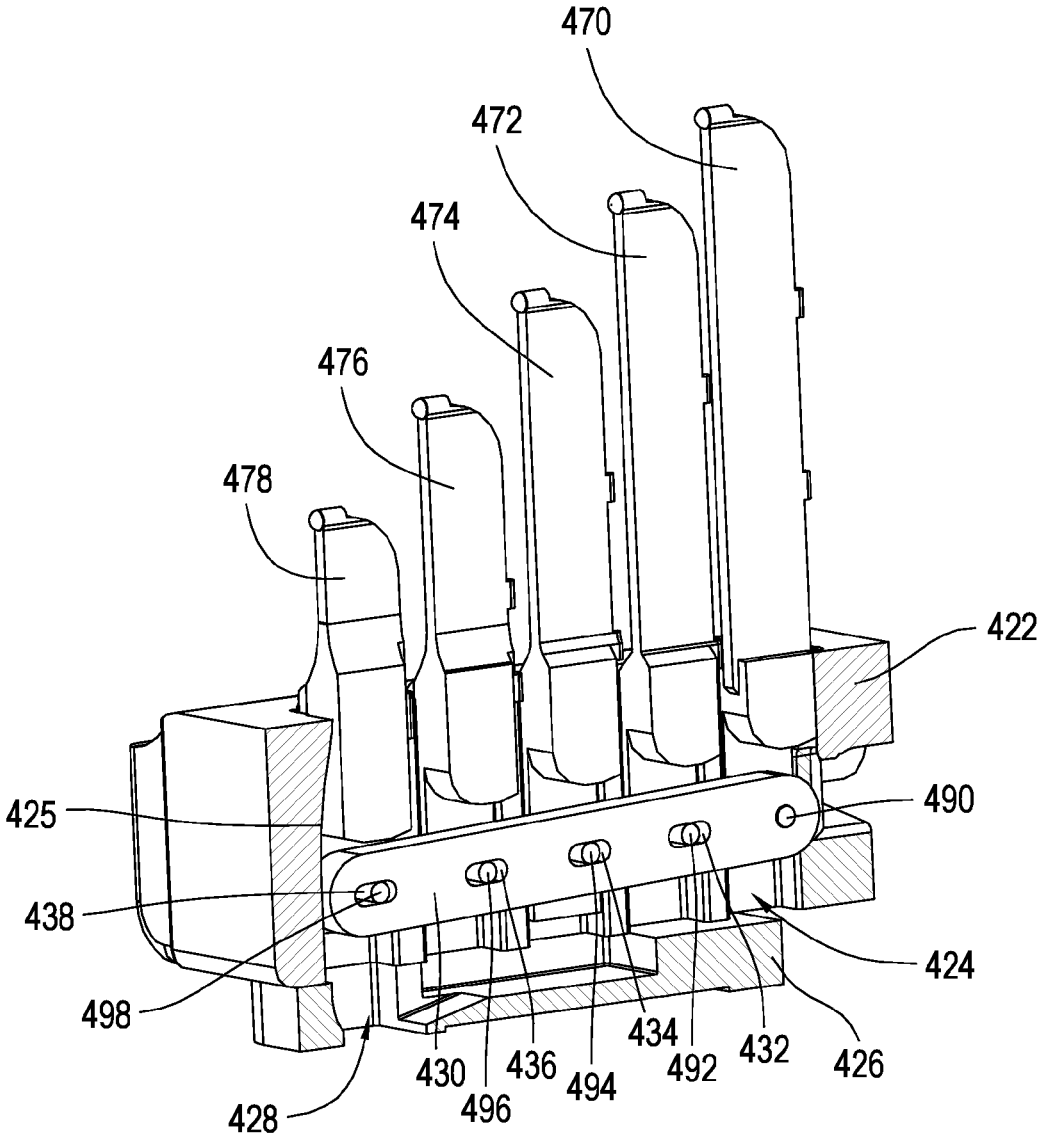
FIG. 20 is a perspective cross-sectional view of the adjustment mechanism of FIG. 15.
Figure 21:
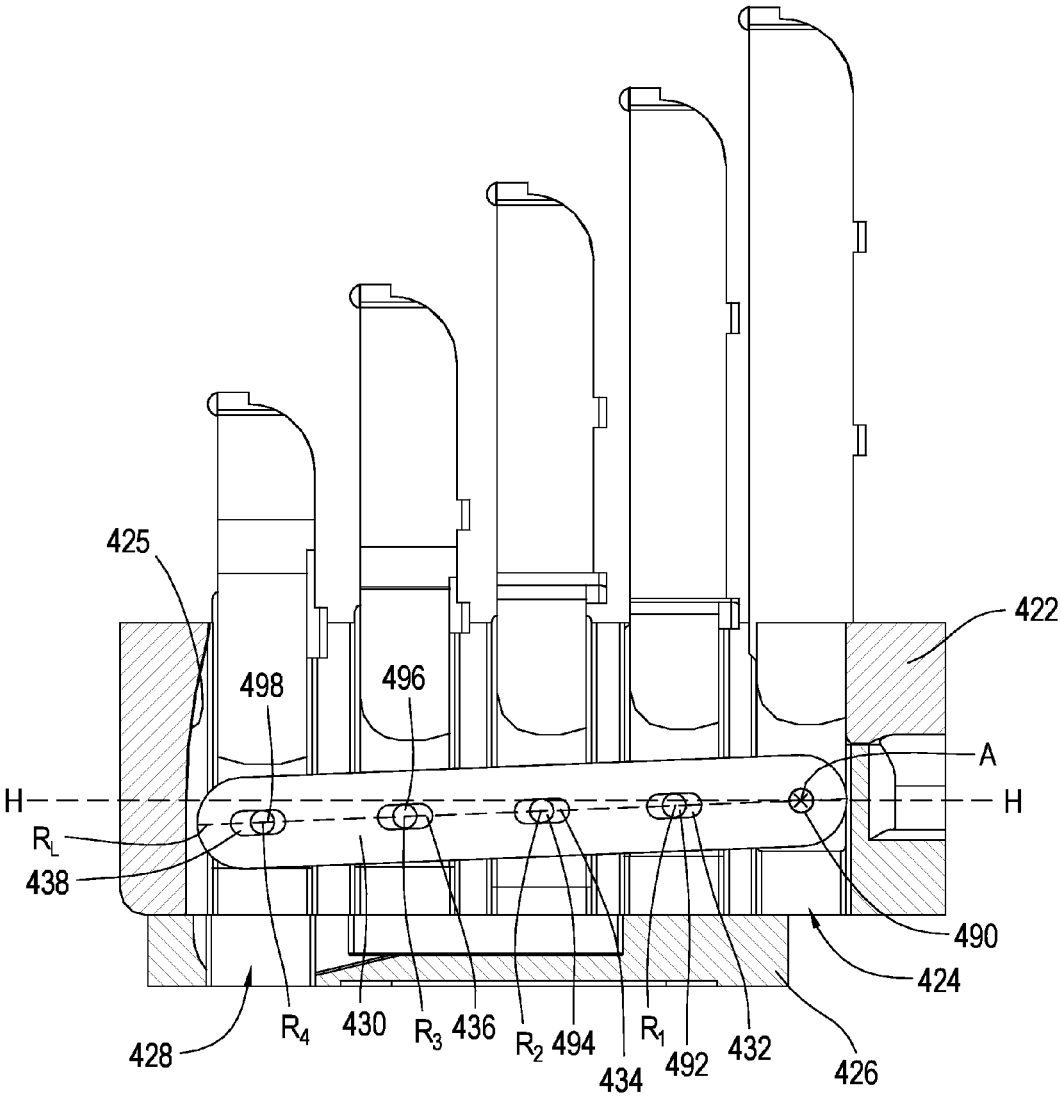
FIG. 21 is a side cross-sectional view of the adjustment mechanism of FIG. 15.

As illustrated in FIGS. 19-21, vertical pins 470, 472, 474, 476 and 478 are rotatable secured within internal cavities to a connection arm such as adjustable lever arm 430. In the illustrated embodiment, vertical pins 470, 472, 474, 476 and 478 include pin bases 480, 482, 484, 486 and 486 which engage respective pivot pins 490, 492, 494, 496 and 498. Pivot pin 490 of fixed pin 470 engages a corresponding circular opening in lever 430, and pivot pins 492, 494, 496 and 498 engage respective slots 432, 434, 436, and 438 in lever arm 430.

Optionally, pin 470 can be slightly adjusted in height relative to upper cover 422 and can be selectively fixed in place, for example with a pair of opposing set screws 468. With pin 470 fixed in place, pivot pin 490 defines the pivot axis A of lever arm 430, such that rotation of lever arm 430 causes the respective heights of pins 472, 474, 476 and 478 to change.

More specifically, the locations of pins 492, 494, 496 and 498 define respective radii $R_1$, $R_2$, $R_3$ and $R_4$ from axis A along the radius $R_L$ of lever arm 430. As lever arm 430 rotates, slots 432, 434, 436 and 438 bear on respective pivot pins 492, 494, 496 and 498 correspondingly causing the pivot pins and respective sight pins to change in height. The selection of respective radii $R_1$, $R_2$, $R_3$ and $R_4$ controls a selected proportional height adjustment of the respective sight pins. The lengths of slots 432, 434, 436 and 438 allow a slight movement of pivot pins 492, 494, 496 and 498 to account for the radial movement of lever arm 430 while pins 472, 474, 476 and 478 are constrained to move vertically.

As illustrated in FIG. 19, the pin height within adjustment mechanism 420 may be selectively controlled by an archer, for example using a threaded control screw 460 extending upward from threaded opening 425 in lower cover 426. In the illustrated embodiment, control screw 460 engages threaded opening 465 defined in a control base 464 extending from one of the adjustable sight pins, for example secured to base 484 of pin 474. The control screw 464 can be selectively rotated with a tool such as a hex or Allen wrench to raise or lower base 464, which correspondingly raises pin base 484 and by association pivots lever arm 430 around axis A to proportionately raise or lower each of the adjustable sight pins. In alternate embodiments, control screw may extend out of lower cover 426 and may be manually adjustable, for example having a cap forming a control knob.

In certain preferred embodiments, as illustrated in FIG. 21, upper cover 422 and pivot pin 490 define a substantially horizontal axis H which defines a central or mid-point axis relative to which lever arm 430 may be adjusted upward or downward. The upper and lower travel distances of the pin bases and lever arm are also limited by the sizes of the upper and lower internal cavities 424 and 428. Optionally, the forward wall 425 of the upper and lower internal cavities 424 and 428 is formed with a slight forwardly concave curve to accommodate the radial movement of the forward end of lever arm 430.

In use, the sight assembly 410 is adjusted so that first pin 470, or alternately a selected pin of fixed height, is calibrated to a first distance. The adjustment mechanism 420 is used to adjust a second pin to a second distance. After correctly aligning the first and second pins, the remaining pins will already be adjusted to corresponding distances.

Figure 22:
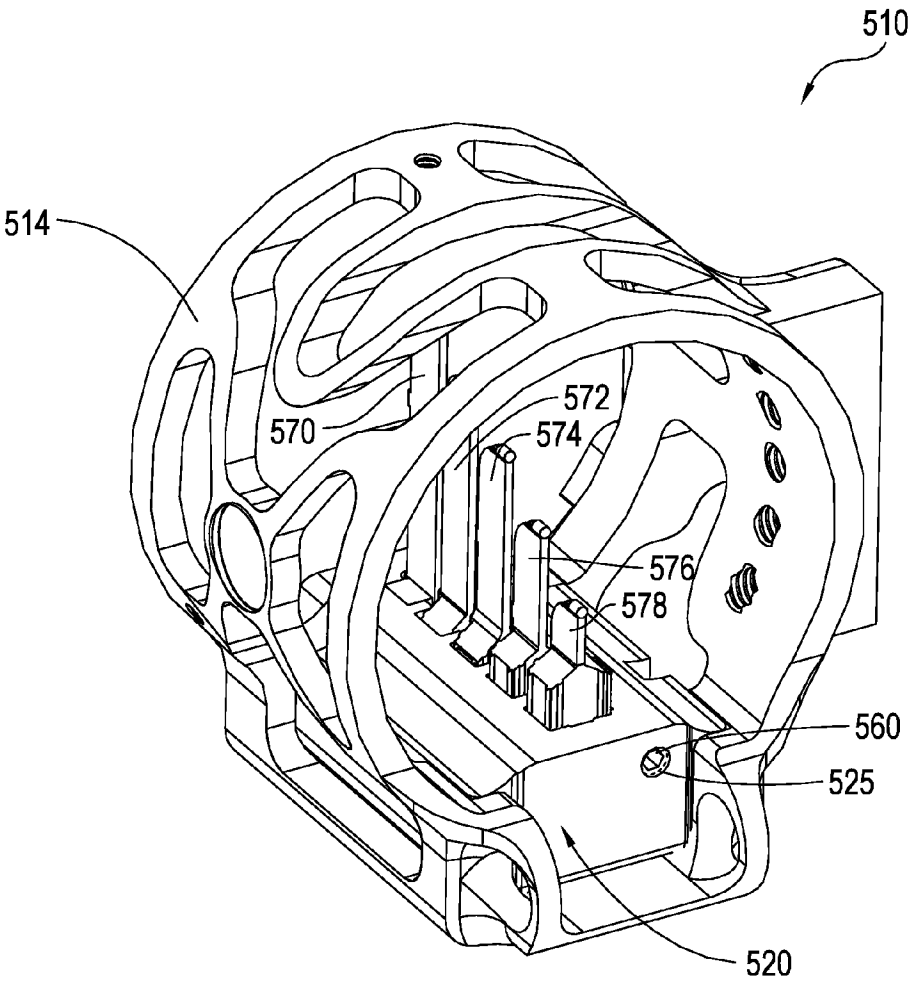
FIG. 22 is a perspective rear view of an alternate adjustment mechanism embodiment usable in the sight guard and sight assembly of FIG. 15.
Figure 23:
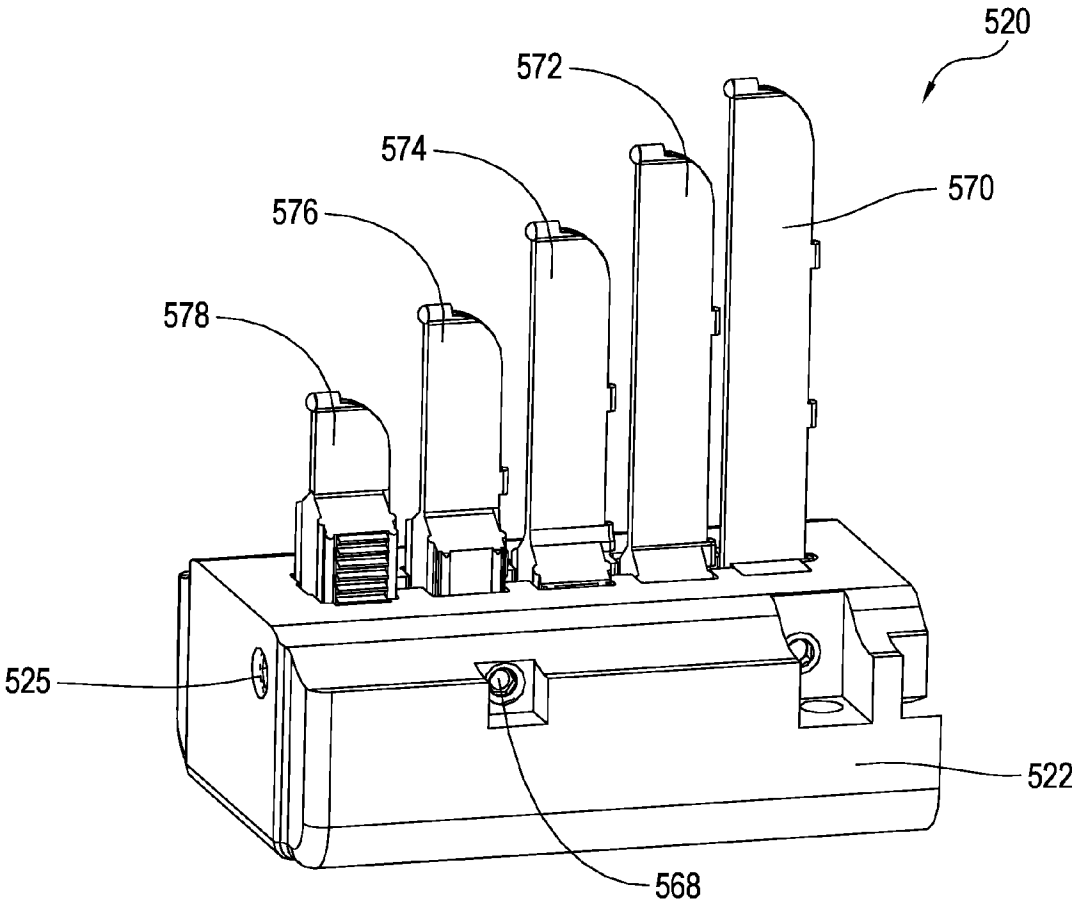
FIG. 23 is a perspective view of the adjustment mechanism of FIG. 22.
Figure 24:
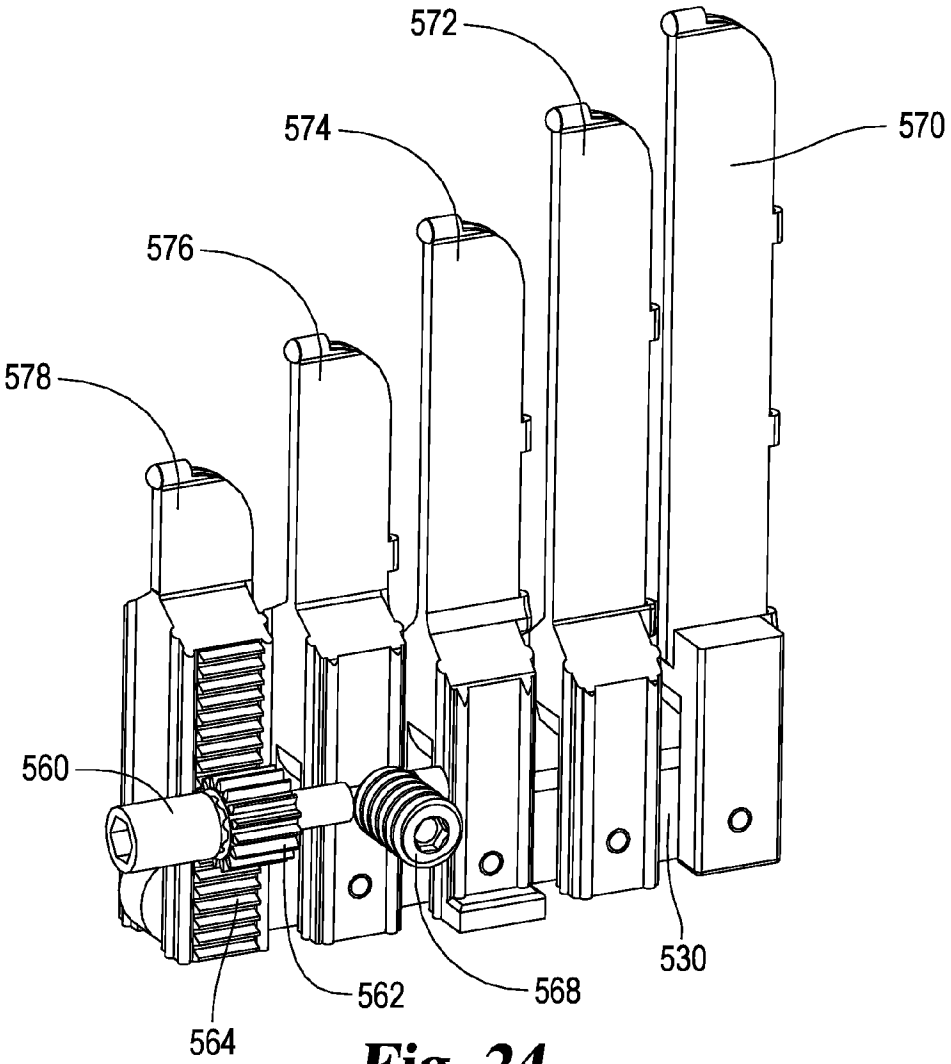
FIG. 24 is a perspective internal view of the adjustment mechanism of FIG. 23.

FIGS. 22-24 illustrate a bow sight assembly 510 in a sight guard 514, which is an alternate embodiment of adjustment mechanism 410 shown in FIGS. 15-21. Optionally, sight assembly 510 can be substituted for sight assembly 410 as shown in FIG. 15. For example, adjustment mechanism 520 can be secured to the lower side of sight guard 514, for example with mounting screws extending through the floor of the sight guard and into the adjustment mechanism cover. Portions of adjustment mechanism 520 are illustrated separately from the overall sight assembly in FIGS. 23-24 for ease of reference.

The adjustable pins, pins 572, 574, 576 and 578 as illustrated, are adjustable in height and mounted, for example, in respective vertical channels defined in adjustment mechanism 520. The adjustment mechanism 520 includes a cover 522 which defines an internal cavity. An adjustment screw opening 525 is defined in the rearward face of cover 522.

As illustrated in FIG. 24 and functioning in the same manner as is shown in FIGS. 19-21, vertical pins 570, 572, 574, 576 and 578 are rotatable secured within the internal cavity to an adjustable lever arm 530. In the illustrated embodiment, the vertical pins include pin bases which engage respective pivot pins. The pivot pin of fixed pin 570 engages a corresponding circular opening in lever 530, and the remaining pivot pins engage respective slots in lever arm 530. Optionally, pin 570 can be slightly adjusted in height relative to cover 522 and can be selectively fixed in place, for example with a pair of opposing set screws. With pin 570 fixed in place, its pivot pin defines the pivot axis of lever arm 530, such that rotation of lever arm 530 causes the respective heights of pins 572, 574, 576 and 578 to change. The description of the geometries of the pins, axis A, and the radii of the pin bases along arm 530 discussed with respect to FIGS. 20-21 also applies to the embodiment shown in FIGS. 23-24

FIG. 24 shows that the pin height within adjustment mechanism 520 may be selectively controlled by an archer, for example using a control shaft 560 extending rearward to an opening 525 defined in the rearward face of cover 522. In the illustrated embodiment, the control shaft 560 has a splined middle portion to extend through and engage a pinion gear 562 within the internal cavity. Rotation of shaft 560 rotates pinion gear 562. Control shaft 560 can be selectively rotated with a tool such as a hex or Allen wrench. In alternate embodiments, the control shaft may extend out of lower cover 522 and may be manually adjustable, for example having a cap forming a control knob. The shaft 560 is retained in the assembly and in pinion gear 562 by a set screw 568. Alternately, the shaft 560 and pinion gear 562 can be made as an integral piece.

Pinion gear 562 engages a rack gear 564 on the base of a pin, such as pin 578. Rack gear 564 may be integrally formed with the pin or separately made and mounted to the pin. When an archer turns control shaft 560, it rotates pinion gear 562 and correspondingly raises or lowers rack gear 564 and pin 578. The movement of pin 578 by association rotates lever arm 530 around its pivot point to proportionately raise or lower each of the adjustable sight pins.

In use, the sight assembly 510 is adjusted so that first pin 570, or alternately a selected pin of fixed height, is calibrated to a first distance. The adjustment mechanism 520 is used to adjust a second pin to a second distance. After correctly aligning the first and second pins, the remaining pins will already be adjusted to corresponding distances.

Certain illustrated embodiments show a mechanism which may be manually adjusted by rotation. Alternately, any mechanical control can be used in any of the embodiments to allow fine adjustments of the rotational movement.

Conventional materials may be used to make embodiments of the archery sights disclosed. Examples of such materials include metals such as aluminum, steel or titanium or plastic component pieces as appropriate. Appropriate connectors and fasteners such as screws and pins are used to assemble the archery sights, some of which have been illustrated, but not all of which have been discussed in detail. Appropriate use of such connectors as illustrated herein will be understood by those with skill in the art.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. An archery bow sight assembly, comprising:

a sight body assembly;

a non-adjustable fixed sight pin with a base extending vertically to a sight point, wherein said fixed sight pin has a fixed height relative to said sight body assembly;

at least two adjustable sight pins in said assembly each with a base wherein each sight pin extends vertically to a sight point, wherein said adjustable sight pins are adjustably mounted in height relative to said fixed sight pin; and wherein the spacing between said adjustable sight pins can be concurrently proportionally adjusted to different heights.

2. The assembly of claim 1, comprising a mechanism linking said adjustable sight pins so that changing the height of one of said adjustable sight pins changes the spacing between the heights of all of said adjustable sight pins.

3. The assembly of claim 2 wherein said mechanism comprises:

a plurality of rotatable nut portions, wherein each rotatable nut portion is threadedly connected to the base of a corresponding adjustable sight pin wherein rotation of said nut portions proportionally adjusts the heights of said adjustable sight pins;

a timing belt wherein said timing belt drives said rotatable nut portions; and wherein said mechanism enables a user to rotate one of said nut portions which rotates said timing belt, causing rotation of the other nut portions.

4. The assembly of claim 3, wherein the threading pitch of said rotatable nut portions differs for each nut portion and wherein each nut portion is matched to threading on the base of a corresponding sight pin so that rotating said nuts an equal rotational amount proportionally adjusts the heights of said adjustable sight pins by different height amounts.

5. The assembly of claim 2, wherein said mechanism comprises:

a plurality of rotatable bases wherein each rotatable base has an interior threaded bore that threadedly engages with one of said adjustable sight pins wherein the threaded bores of said rotatable bases each have a different pitch;

outer gears on the exterior of each of said rotatable bases, wherein said outer gears are engaged in series; and a control gear wherein rotation of said control gear drives one of said outer gears which drives the other outer gears to proportionally adjust the height of all of said adjustable vertical pins.

6. The assembly of claim 1, wherein the spacing between the heights of said adjustable sight pins is adjusted using a gear arrangement.

7. The assembly of claim 6, wherein said gear arrangement is a rack and pinion gear arrangement wherein a control feature operates pinion gears on a shared pinion body that drives separate rack gears associated with each of said adjustable sight pins.

8. The assembly of claim 7, wherein the radii and gear tooth spacing of said pinion gears are proportionally sized and spaced to proportionally adjust the heights of corresponding adjustable sight pins by different distances.

9. The assembly of claim 7, wherein said pinion body defines an axis of rotation which is angled so it is non-parallel relative to an axis aligning the bases of said sight pins.

10. An archery bow sight assembly, comprising:

a sight body assembly;

a non-adjustable fixed height sight pin extending vertically to a sight point fixed in height relative to said sight body assembly;

a plurality of adjustable sight pins wherein each pin extends vertically to a sight point, wherein said pins are adjustable in height relative to said fixed sight pin;

a mechanism allowing a user to adjust the height of one of said adjustable sight pins;

wherein said adjustable sight pins are linked so that adjusting the height of one pin with said mechanism concurrently proportionally adjusts the spacing between the heights of each of the other adjustable sight pins according to a range formula.

11. The assembly of claim 10 wherein said mechanism comprises:

a plurality of rotatable nut portions wherein each rotatable nut portion is threadedly connected to the base of a corresponding adjustable sight pin;

a timing belt wherein said timing belt drives said rotatable nut portions;

wherein said mechanism enables a user to rotate one of said nut portions which rotates said timing belt causing rotation of the other nut portions; and, wherein rotation of said nut portions proportionally adjusts the heights of said adjustable sight pins.

12. The assembly of claim 11, wherein the threading of said rotatable nut portions is matched to threading on the base of said sight pins to proportionally adjust the heights of said adjustable sight pins.

13. The assembly of claim 10 wherein said mechanism comprises:

a plurality of rotatable bases wherein each rotatable base has an interior threaded bore that threadedly engages with one of said adjustable sight pins;

outer gears on the exterior of each of said rotatable bases, wherein said outer gears are engaged in series;

a control gear wherein rotation of said control gear drives one of said outer gears and when said one outer gear drives the other outer gears to proportionally adjust the heights of said adjustable vertical pins.

14. The assembly of claim 13, wherein the threaded bores of said rotatable bases each have a different pitch.

15. An archery bow sight assembly, comprising:

a sight body assembly;

at least three sight pins each with a base;

a connection arm connected to said sight pins at said bases wherein said connection arm pivots around a connection point at one of said bases;

wherein vertically pivoting said connection arm proportionally adjusts the vertical position of said sight pins by a height in a ratio determined by the distance from said base to said connection point at which said connection arm pivots.

16. The assembly of claim 15, wherein one of said sight pins has a fixed height relative to said sight body assembly.

17. The assembly of claim 16, wherein the pivot point of said connection arm is at the base of said fixed sight pin.

18. The assembly of claim 15, wherein said connection arm can be pivoted by turning a control screw.

19. The assembly of claim 18, wherein turning said control screw operates a pinion gear which drives a rack gear associated with said connection arm.

* * * * *